US009022876B2

(12) United States Patent
Snyder et al.

(10) Patent No.: US 9,022,876 B2
(45) **Date of Patent: *May 5, 2015**

(54) PUTTER HEADS AND PUTTERS

(75) Inventors: Jeremy N. Snyder, Benbrook, TX (US); Jason P. Martin, Lake Oswego, OR (US); Carl A. Jonsson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 459 days.

This patent is subject to a terminal disclaimer.

(21) Appl. No.: 13/305,408

(22) Filed: Nov. 28, 2011

(65) Prior Publication Data

US 2012/0220386 A1 Aug. 30, 2012

Related U.S. Application Data

(63) Continuation-in-part of application No. 12/961,799, filed on Dec. 7, 2010.

(60) Provisional application No. 61/526,344, filed on Aug. 23, 2011.

(51) Int. Cl.
*A63B 69/36* (2006.01)
*A63B 53/04* (2006.01)
(Continued)

(52) U.S. Cl.
CPC ..... *A63B 53/0487* (2013.01); *A63B 53/08* (2013.01); *A63B 59/0088* (2013.01); *A63B 2053/042* (2013.01); *A63B 2053/0425* (2013.01);
(Continued)

(58) Field of Classification Search
USPC ..... 473/251–254, 244–246, 340–341; D21/736–746
See application file for complete search history.

(56) References Cited

U.S. PATENT DOCUMENTS 1,289,553 A 12/1918 Sanders
2,005,401 A 6/1935 Storz
(Continued)

FOREIGN PATENT DOCUMENTS

GB 2313552 A 12/1997
GB 2388792 A 11/2003
(Continued)

OTHER PUBLICATIONS

C-Groove—Development, Harold Swash Putting School of Excellence, (Aug. 26, 2008), ; http://www.haroldswashputting.co.uk/haroldswash_development.htm.
(Continued)

*Primary Examiner* — Sebastiano Passaniti
(74) *Attorney, Agent, or Firm* — Banner & Witcoff, Ltd.

(57) ABSTRACT

Putter heads include a ball striking head body member and a rear body member. In some putter heads, the ball striking head body member includes a rearwardly extending body support having an opening defined therein, and the rear body member extends through this opening. In other putter heads, the rear body member includes a forwardly projecting platform that includes an alignment aid thereon. In still other putter heads, the ball striking head body member includes rearward extending arms at the heel and toe sides that extend rearward at an angle to a location outside the heel and toe edges, respectively, of the ball striking face. Additionally, the rear body member of other putter heads have a first end engaged at a heel side of the ball striking head body member and a free second end that is not engaged with any portion of the putter head.

30 Claims, 20 Drawing Sheets

(51) Int. Cl.
*A63B 53/08* (2006.01)
*A63B 59/00* (2006.01)

(52) U.S. Cl.
CPC . *A63B 2053/0441* (2013.01); *A63B 2053/0445* (2013.01); *A63B 2053/0491* (2013.01)

(56) References Cited

U.S. PATENT DOCUMENTS

| | | | | |
|---|---|---|---|---|
| 2,429,351 | A | 10/1947 | Fetterolf | |
| D188,857 | S | 9/1960 | Mospan | |
| D210,033 | S | 1/1968 | Johnston | |
| 1,873,423 | A | 12/1970 | Govan | |
| 3,695,618 | A | 10/1972 | Woolley et al. | |
| D235,668 | S * | 7/1975 | Swash | D21/739 |
| 3,921,984 | A | 11/1975 | Winter | |
| 3,979,125 | A | 9/1976 | Lancellotti | |
| 4,679,792 | A | 7/1987 | Straza et al. | |
| 5,080,365 | A | 1/1992 | Winchell | |
| D327,932 | S | 7/1992 | Stuff | |
| 5,248,145 | A | 9/1993 | Brown | |
| 5,354,059 | A | 10/1994 | Stuff | |
| 5,358,249 | A | 10/1994 | Mendralla | |
| 5,398,929 | A | 3/1995 | Kitaichi | |
| 5,497,993 | A | 3/1996 | Shan | |
| 5,505,450 | A | 4/1996 | Stuff | |
| 5,518,235 | A | 5/1996 | Mendenhall | |
| 5,533,728 | A | 7/1996 | Pehoski et al. | |
| 5,542,675 | A | 8/1996 | Micciche et al. | |
| 5,620,381 | A | 4/1997 | Spalding | |
| 5,624,331 | A | 4/1997 | Lo et al. | |
| 5,637,044 | A | 6/1997 | Swash | |
| 5,655,976 | A | 8/1997 | Rife | |
| 5,766,093 | A | 6/1998 | Rohrer | |
| 5,769,737 | A | 6/1998 | Holladay et al. | |
| 5,772,527 | A | 6/1998 | Liu | |
| 5,807,190 | A | 9/1998 | Krumme et al. | |
| 5,820,481 | A * | 10/1998 | Raudman | 473/313 |
| 5,830,078 | A * | 11/1998 | McMahan | 473/252 |
| 5,944,619 | A | 8/1999 | Cameron | |
| 5,972,144 | A | 10/1999 | Hsu | |
| 6,017,281 | A * | 1/2000 | Behling | 473/330 |
| 6,019,686 | A * | 2/2000 | Gray | 473/313 |
| 6,093,116 | A | 7/2000 | Hettinger et al. | |
| 6,200,229 | B1 | 3/2001 | Grace et al. | |
| 6,302,807 | B1 | 10/2001 | Rohrer | |
| 6,309,310 | B1 | 10/2001 | Shira | |
| 6,334,818 | B1 | 1/2002 | Cameron et al. | |
| 6,348,014 | B1 | 2/2002 | Chiu | |
| 6,350,208 | B1 | 2/2002 | Ford | |
| 6,431,997 | B1 | 8/2002 | Rohrer | |
| 6,558,272 | B2 | 5/2003 | Helmstetter et al. | |
| 6,652,390 | B2 * | 11/2003 | Bradford | 473/341 |
| 6,699,140 | B1 | 3/2004 | Sun | |
| 6,837,801 | B1 * | 1/2005 | Souza et al. | 473/251 |
| 6,893,355 | B2 | 5/2005 | Souza et al. | |
| 6,896,625 | B2 | 5/2005 | Grace | |
| 6,921,343 | B2 | 7/2005 | Solheim | |
| 6,932,716 | B2 | 8/2005 | Ehlers et al. | |
| 6,958,019 | B2 | 10/2005 | Rohrer | |
| 7,018,304 | B2 * | 3/2006 | Bradford | 473/334 |
| 7,048,646 | B2 * | 5/2006 | Yamanaka et al. | 473/332 |
| 7,052,409 | B2 * | 5/2006 | Goldsmith | 473/242 |
| 7,166,039 | B2 | 1/2007 | Hettinger et al. | |
| 7,261,644 | B2 | 8/2007 | Burrows | |
| 7,278,926 | B2 | 10/2007 | Frame | |
| 7,281,990 | B2 | 10/2007 | Hagood et al. | |
| 7,354,356 | B2 * | 4/2008 | Yamanaka et al. | 473/332 |
| 7,377,858 | B2 | 5/2008 | Kubota | |
| 7,390,267 | B2 * | 6/2008 | Grace | 473/251 |
| 7,396,294 | B2 * | 7/2008 | Consiglio | 473/332 |
| 7,407,443 | B2 * | 8/2008 | Franklin et al. | 473/251 |
| 7,445,562 | B2 * | 11/2008 | Sano | 473/332 |
| D588,222 | S | 3/2009 | Takahashi | |
| 7,594,862 | B2 | 9/2009 | Gilbert | |
| 7,594,863 | B2 | 9/2009 | Ban | |
| D605,242 | S | 12/2009 | Franklin et al. | |
| 7,670,232 | B2 * | 3/2010 | Franklin et al. | 473/251 |
| D615,140 | S | 5/2010 | Franklin et al. | |
| 7,717,801 | B2 | 5/2010 | Franklin et al. | |
| 7,717,806 | B2 * | 5/2010 | Kubota | 473/340 |
| 7,722,478 | B2 * | 5/2010 | Ebner | 473/335 |
| 7,758,449 | B2 | 7/2010 | Gilbert et al. | |
| 7,780,549 | B2 | 8/2010 | Park et al. | |
| 7,794,333 | B2 | 9/2010 | Wallans et al. | |
| 7,806,779 | B2 | 10/2010 | Franklin et al. | |
| 7,841,952 | B1 | 11/2010 | Oldknow et al. | |
| 7,846,039 | B2 | 12/2010 | Gilbert et al. | |
| 7,862,449 | B2 | 1/2011 | Stites et al. | |
| 7,927,230 | B2 | 4/2011 | Solheim | |
| 7,942,757 | B2 | 5/2011 | Blumenkrantz et al. | |
| 7,993,213 | B1 * | 8/2011 | D'Eath | 473/288 |
| 8,012,035 | B2 | 9/2011 | Franklin et al. | |
| 8,062,146 | B2 | 11/2011 | Franklin et al. | |
| 8,083,605 | B2 | 12/2011 | Franklin et al. | |
| 8,083,611 | B2 | 12/2011 | Kuan et al. | |
| D657,834 | S | 4/2012 | Oldknow et al. | |
| D658,246 | S * | 4/2012 | Oldknow et al. | D21/736 |
| 8,210,962 | B2 | 7/2012 | Franklin et al. | |
| 8,216,081 | B2 | 7/2012 | Snyder et al. | |
| 8,303,434 | B1 | 11/2012 | Depaul | |
| 8,506,415 | B2 * | 8/2013 | Franklin | 473/251 |
| 2004/0242342 | A1 | 12/2004 | Patten | |
| 2005/0009623 | A1 | 1/2005 | Dickinson | |
| 2005/0209020 | A1 | 9/2005 | Burrows | |
| 2005/0215354 | A1 | 9/2005 | Kumamoto | |
| 2005/0233829 | A1 | 10/2005 | Cameron | |
| 2005/0261080 | A1 | 11/2005 | Bradford | |
| 2005/0277487 | A1 | 12/2005 | Takeda | |
| 2006/0058113 | A1 | 3/2006 | Hasegawa | |
| 2006/0223649 | A1 * | 10/2006 | Rife | 473/334 |
| 2007/0037632 | A1 | 2/2007 | Jorgensen | |
| 2007/0142122 | A1 | 6/2007 | Bonneau | |
| 2007/0161430 | A1 | 7/2007 | Bardha | |
| 2007/0191135 | A1 | 8/2007 | Nilsson et al. | |
| 2007/0243949 | A1 | 10/2007 | Solari | |
| 2008/0125241 | A1 | 5/2008 | Tateno et al. | |
| 2008/0171610 | A1 * | 7/2008 | Shin | 473/291 |
| 2008/0207351 | A1 | 8/2008 | Wallans et al. | |
| 2008/0293511 | A1 | 11/2008 | Gilbert | |
| 2009/0105008 | A1 | 4/2009 | Kuan et al. | |
| 2009/0131197 | A1 | 5/2009 | Miyamichi | |
| 2009/0149271 | A1 | 6/2009 | Nakamura | |
| 2009/0270198 | A1 * | 10/2009 | Solheim et al. | 473/340 |
| 2009/0286620 | A1 | 11/2009 | Franklin et al. | |
| 2009/0286621 | A1 | 11/2009 | Franklin et al. | |
| 2010/0087269 | A1 | 4/2010 | Snyder et al. | |
| 2010/0113179 | A1 | 5/2010 | Solheim | |
| 2010/0167835 | A1 | 7/2010 | Franklin et al. | |
| 2010/0167836 | A1 | 7/2010 | Horii et al. | |
| 2010/0184532 | A1 | 7/2010 | Boyd et al. | |
| 2010/0234127 | A1 | 9/2010 | Snyder et al. | |
| 2011/0034268 | A1 | 2/2011 | Franklin et al. | |
| 2011/0039633 | A1 | 2/2011 | Snyder et al. | |
| 2011/0070971 | A1 | 3/2011 | Franklin et al. | |
| 2012/0083353 | A1 * | 4/2012 | Franklin et al. | 473/251 |
| 2012/0184393 | A1 | 7/2012 | Franklin | |
| 2012/0220386 | A1 | 8/2012 | Snyder et al. | |

FOREIGN PATENT DOCUMENTS

| | | | |
|---|---|---|---|
| JP | 2005066249 | A | 3/2005 |
| JP | 2007175202 | A | 7/2007 |
| KR | 20080047955 | A | 5/2008 |
| WO | 2009152313 | A1 | 12/2009 |

OTHER PUBLICATIONS

Rife Two Bar Hybrid Putter Review, Putter Zone Golf, (Mar. 7, 2008), http://www.putterzone.com/2008/03/rife-twobar-hybrid-putter-review.html.

European Patent Office, Search Report issued in European Patent Application No. 11159319.0 dated Sep. 23, 2011.

(56) References Cited

OTHER PUBLICATIONS

International Search Report received in PCT Patent Application No. PCT/US2009/044331 mailed Sep. 10, 2009.
International Search Report received in PCT Patent Application No. PCT/US2010/031156 mailed Jul. 6, 2010.
International Search Report received in PCT Patent Application No. PCT/US2010/051432 mailed Mar. 30, 2011.
International Search Report received in PCT Patent Application No. PCT/US2011/028674 mailed Jul. 18, 2011.
Search Report Dated Dec. 16, 2013 From Taiwan Application No. 100144635, With English Translation.
Office Action Dated Jul. 15, 2014 in EP Application No. 11799552.2.
Office Action Dated Jul. 25, 2014 in Taiwan Application 100144635.
Feb. 9, 2015—(JP) Office Action—App. 2013-543233.

* cited by examiner

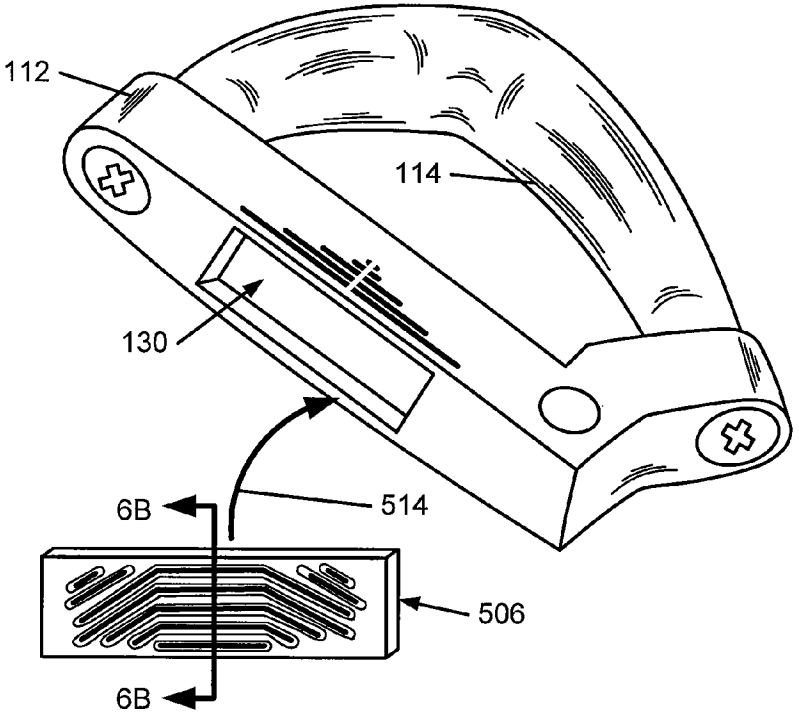
FIG. 6A
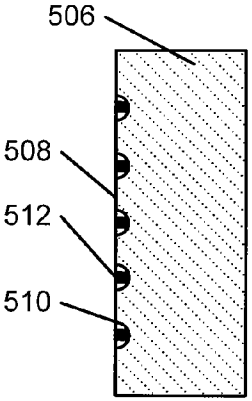
FIG. 6B
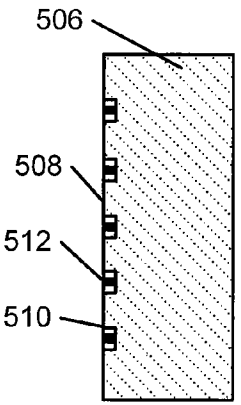
FIG. 6C
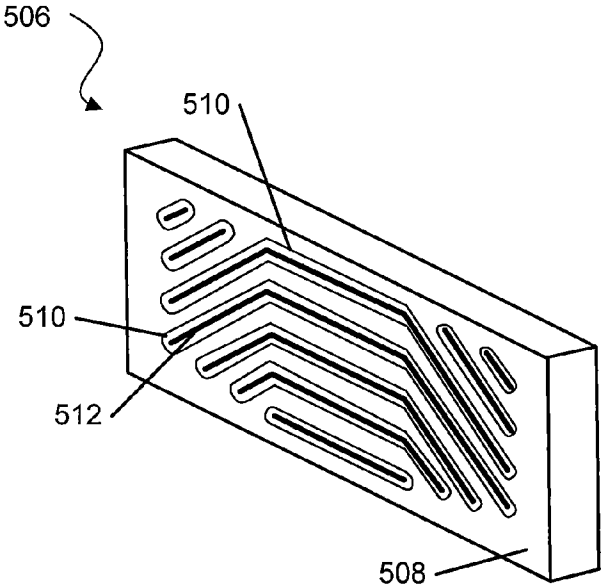

PUTTER HEADS AND PUTTERS

RELATED APPLICATION INFORMATION

This application is a continuation in part of U.S. patent application Ser. No. 12/961,799 filed Dec. 7, 2010 in the names of David N. Franklin, Jeremy N. Snyder, Michael R. Pinto, Carl Jonsson, and Gregory Scott Hinzmann and entitled "Customizable Putter Heads and Putters Including Polymeric Material as Part of the Ball Striking Face." Additionally, this application claims priority benefits based on U.S. Provisional Patent Appln. No. 61/526,344 filed Aug. 23, 2011 in the names of Jeremy N. Snyder, Jason Martin, and Carl Jonsson and entitled "Customizable Putter Heads and Putters Including Polymeric Material as Part of the Ball Striking Face." Also, this application builds on information contained in the following U.S. patents and patent applications: (a) U.S. Pat. No. 7,717,801 issued May 18, 2010 in the names of David N. Franklin and John Thomas Stites and entitled "Putter Heads and Putters Including Polymeric Material as Part of the Ball Striking Face," (b) U.S. Pat. No. 7,806,779 issued Oct. 5, 2010 in the names of David N. Franklin and John Thomas Stites and entitled "Putter Heads and Putters Including Polymeric Material as Part of the Ball Striking Face," (c) U.S. patent application Ser. No. 12/612,236 filed Nov. 4, 2009 in the names of Jeremy N. Snyder, David N. Franklin, John T. Stites, and Donald S. Rahrig entitled "Putter Heads and Putters Including Polymeric Material as Part of the Ball Striking Face," and (d) U.S. patent application Ser. No. 12/755,330 filed Apr. 6, 2010 in the names of Jeremy N. Snyder, John T. Stites, David N. Franklin, and Donald S. Rahrig entitled "Putter Heads and Putters Including Polymeric Material as Part of the Ball Striking Face." Each of the above-mentioned patents and patent applications is entirely incorporated herein by reference.

FIELD OF THE INVENTION

This invention relates generally to putter heads and putters, as well as to methods of making and using these putting devices. Putter heads and putters in accordance with at least some examples of this invention may be constructed to include polymeric and/or damping materials on the putter body and/or as at least a portion of the ball striking surface. Furthermore, in accordance with some aspects of this invention, the putters and putter heads may include various customization features.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well-known golf superstars, at least in part, have increased golf's popularity in recent years.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, balancing, and the like all may affect the "feel" of the club as it swings and strikes a ball. "Feel" also has been found to be related to the visual appearance of the club and the sound produced when the club head strikes a ball to send the ball in motion.

To successfully putt a ball in the hole, the ball must be launched at the proper combination of speed and direction to arrive at the intended destination. While some errors in putt speed and direction may be the result of mental or physical mistakes by the player (e.g., mis-hits, mis-alignment, poor speed and/or line choice, etc.), the putter also can contribute to inconsistencies in ball launch speed and launch direction that result in missed putts. For example, if the putter head twists in the player's hands before or during ball contact, this may cause the ball to start out "off-line," with some undesired spin, and/or at the wrong speed. As another example, if the ball is launched with backspin or bounces excessively during the early phase of its locomotion, this can cause inconsistencies in ball speed. All of these things may result in missed putts and inconsistent putting.

While technological improvements to putter designs have been made, because of the very personal nature of the putting stroke and the "feel" aspects of putting a golf ball, no single putter structure is best suited for all players. New putter structures that change the look and feel of the club and/or allow customization to individual swings or tastes are welcomed by at least some players. Moreover, technological advances that provide improved and more consistent ball initial launch direction and launch speed would be a welcome advance in the art.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to putters and putter heads that include one or more of the following: (a) a ball striking face body member (made from one or more parts) including a ball striking face having a central portion for contacting a ball during a putting stroke, wherein the central portion includes a plurality of openings defined therein; (b) a polymeric material having a majority thereof located behind an exterior surface of the ball striking face, wherein a portion of the polymeric material is exposed at the exterior surface of the ball striking face through the plurality of openings; (c) a rear body member (made from one or more parts) removably engaged with the ball striking face body member; and (d) for putters, a shaft engaged with at least one of the ball striking face body member and the rear body member.

Additional aspects of this invention relate to putting devices (such as putters or putter heads) that include: (a) a ball striking face body member including a ball striking face having a central recess defined therein; (b) an insert engaged within the central recess of the ball striking face body member, the insert including a polymeric base material, wherein a plurality of depressions are defined in an exposed surface of the polymeric base material, wherein at least some of the plurality of depressions include an edge element mounted therein to thereby provide a ball striking surface of the putter head with grooves defined therein between edges of the depressions and adjacent edges of the edge elements mounted within the depressions; (c) a rear body member removably engaged with the ball striking face body member; and (optionally) (d) a shaft engaged with at least one of the ball striking face body member and the rear body member.

Still additional aspects of this invention relate to putters and putter heads that include: (a) a ball striking face body member including a ball striking face portion extending in a heel-to-toe direction, the ball striking face portion including a ball striking face, a toe side, and a heel side, the ball striking face body member further including an arm extending rearward at the heel side of the ball striking face portion at an obtuse angle (e.g., from 100° to 170°) with respect to the ball striking face; and (b) a rear body member engaged with the ball striking face body member.

In accordance with yet additional aspects of this invention, a putter head may include a putter head body having a ball striking face portion and a rear body portion (as one or more parts), wherein the putter head body has an overall breadth dimension B in a front-to-rear direction and a depth of a center of gravity in the front-to-rear direction $D_{CG}$, wherein a ratio of $D_{CG}/B$ is at least 0.425, and in some examples, at least 0.45, at least 0.48, at least 0.5, at least 0.51, and even at least 0.52. In some examples of this aspect of the invention, the putter heads will have an overall front-to-rear dimension B of at least 2 inches, and in some examples at least 2.25 inches, or even at least 2.5 inches. Such putter head structures also may define an enclosed open area or a through-hole (e.g., defined between a rear of the ball striking face portion and the rear body portion).

Additional aspects of this invention relate to putter heads that include: (a) a ball striking head body member including a rearwardly extending body support having an opening defined therein; and (b) a rear body member having a first end engaged at a toe side of the ball striking head body member, a second end engaged at a heel side of the ball striking head body member, and a central portion between the first end and the second end extending through the opening in the ball striking head body member.

Putter heads according to still other examples of this invention may include: (a) a ball striking head body member; and (b) a rear body member having a first end engaged at a toe side of the ball striking head body member, a second end engaged at a heel side of the ball striking head body member, and a central portion between the first end and the second end, wherein the central portion includes a forwardly projecting platform that includes an alignment aid thereon. Optionally, the ball striking head body member also may include a rearward projecting platform that includes an alignment aid thereon.

As yet another example, putter heads according to at least some aspects of this invention may include: a ball striking head body member including: (a) a first rearward extending arm at a heel side of the ball striking head body member, wherein the first rearward extending arm extends rearwardly from a ball striking face of the ball striking head body member at an angle to a location outside a heel edge of the ball striking face, and (b) a second rearward extending arm at a toe side of the ball striking head body member, wherein the second rearward extending arm extends rearwardly from the ball striking face at an angle to a location outside a toe edge of the ball striking face. Such putter heads further may include a rear body member having a first end engaged with the first rearward extending arm and a second end engaged with the second rearward extending arm, wherein the rear body member includes a rubberized tungsten material and optionally a stainless steel material.

Still another example aspect of this invention relates to putter heads that include: (a) a ball striking head body member; and (b) a rear body member having a first end engaged at a heel side of the ball striking head body member and a free second end that is not engaged with any portion of the putter head (e.g., hanging free, not engaged with the ball striking head body member).

Additional aspects of this invention relating to putting systems or kits that may include various interchangeable parts. As one example, such a putting system may include: (a) one or more ball striking face body members of the types described above; (b) a first rear body member removably engagable with the ball striking face body member(s); (c) a second rear body member removable engagable with the ball striking face body member(s), wherein the first rear body member differs from the second rear body member in at least one manner selected from the group consisting of: weight, weight distribution, material, color, balance, texture, graphics, and shape; and (d) (optionally) a shaft engagable with at least one of the ball striking face body member(s) and the rear body members.

Still additional aspects of this invention relate to methods of making putting devices, e.g., of the various types described above, as well as to methods of interchanging the parts in such putting devices (e.g., to change one or more characteristics of the putting device, such as the characteristics identified above).

BRIEF DESCRIPTION OF THE DRAWINGS

A more complete understanding of the present invention and certain advantages thereof may be acquired by referring to the following detailed description in consideration with the accompanying drawings, in which the same reference numbers indicate the same or similar features, and wherein:

FIGS. 5 through 18B illustrate additional example putter head structures and features in accordance with aspects of this invention.

DETAILED DESCRIPTION

Figure 1A:
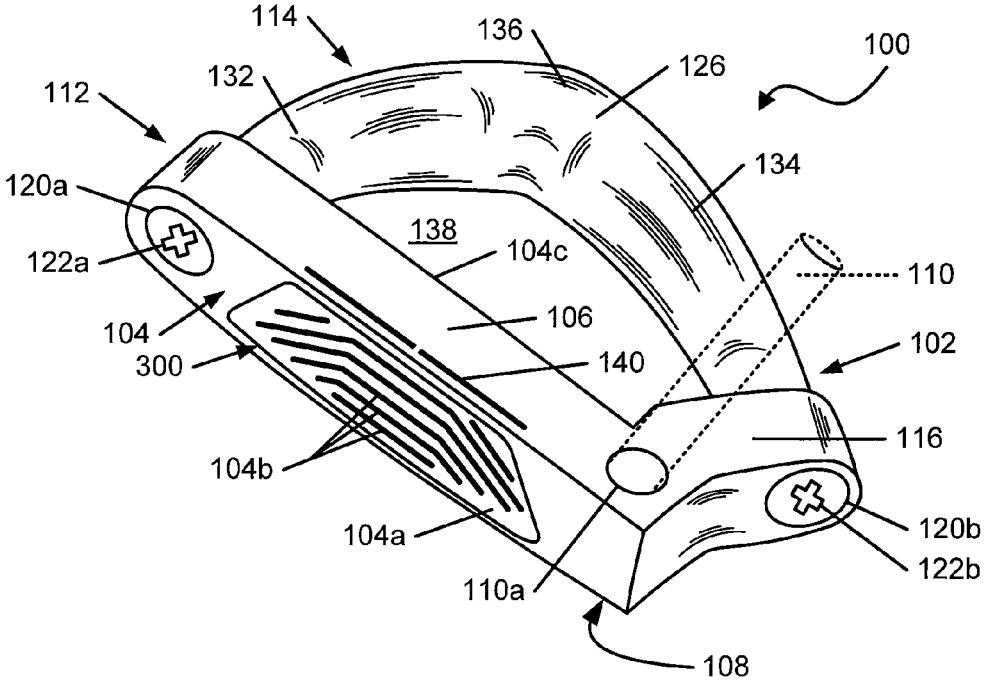
FIGS. 1A through 1D illustrate a first example putter head structure in accordance with some aspects of this invention.

In the following description of various example putter heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures, the orientations during ball address, and/or the orientations during typical use. Nothing in this specification should be construed as requiring a specific three dimensional orientation of structures in order to fall within the scope of this invention.

At least some example aspects of this invention relate to putters and putter heads, as well as to methods of making and using such structures. A general description of various aspects of the invention and a more detailed description of specific examples of the invention follows.

A. General Description of Putters, Putter Heads, and Methods According to Aspects of the Invention In general, aspects of this invention relate to putters and putter heads. Such putters and putter heads, according to at least some examples of the invention, may include one or more of the following: (a) a ball striking face body member (made from one or more parts) including a ball striking face having a central portion for contacting a ball during a putting stroke, wherein the central portion includes a plurality of openings defined therein; (b) a polymeric material having a majority thereof located behind an exterior surface of the ball striking face, wherein a portion of the polymeric material is exposed at the exterior surface of the ball striking face through the plurality of openings; (c) a rear body member (made from one or more parts) removably engaged with the ball striking face body member; and (d) for putters, a shaft engaged with at least one of the ball striking face body member and the rear body member.

In some example structures in accordance with this invention, the central portion of the ball striking face will constitute an insert element that is engaged within an opening or recess provided in a surface of the ball striking face body member. This insert element may include a first, outer, harder layer (e.g., made of a metal material, a polymer material, a ceramic material, etc.) and a second, inner, softer layer that constitutes the polymeric material.

The exterior ball striking face of putter structures in accordance with at least some examples of this invention may include grooves. For example, the exterior surface at the central portion of the ball striking face between a top and a bottom of the putter head may include the polymeric material and a metal material, and wherein a top-to-bottom cross section of the exterior surface at the central portion of the ball striking face may have a structure that includes alternating polymeric material and metal material and a plurality of grooves (e.g., three or more grooves, optionally extending at least partially in parallel with one another). The grooves may be provided such that, in the cross section, a first edge of the groove is defined by metal material and a second edge of the groove opposite the first edge is defined by polymeric material exposed in the openings in the ball striking face.

The putter body also may have a variety of different structures and configurations. As one example, if desired, the ball striking face body member may include an arm extending rearward at a first side of the ball striking face. The rear body member may be engaged with the ball striking face body member in any desired manner, e.g., via a first fastener that extends through the ball striking face and via a second fastener that extends through the arm. The arm, when present as part of a ball striking face body member, may extend at an obtuse angle (e.g., within a range of 100° to 170°, and in some examples, within a range of 110° to 160°, or even within a range of 120° to 150°) with respect to the exterior front surface of the ball striking face and/or a rear side of the ball striking face.

The rear body member may take on a variety of sizes, shapes, weights, weight distributions, colors, color combinations, textures, or other properties without departing from this invention. In one example structure, the rear body member includes a first arm extending rearward at a second side of the ball striking face and a second arm extending from the arm of the ball striking face body member in a toe direction. If desired, an enclosed open space or through-hole may be defined between the rear body member and the ball striking face body member. Also, if desired, the rear body member may be non-symmetric, and, when it is engaged with the ball striking face body member, the rear body member may be non-symmetric with respect to a front-to-rear center line of the putter head.

Other aspects of this invention relate to putter heads having: (a) a ball striking face body member including a ball striking face portion extending in a heel-to-toe direction, the ball striking face portion including a ball striking face, a toe side, and a heel side, the ball striking face body member further including an arm extending rearward at the heel side of the ball striking face portion at an obtuse angle (e.g., from 100° to 170°) with respect to the ball striking face; and (b) a rear body member engaged with the ball striking face body member. If desired, the rear body member may be removably engaged with the ball striking face body member, e.g., via a first fastener that extends through the ball striking face and via a second fastener that extends through the arm. In some example structures in accordance with this invention, the rear body member may be non-symmetric with respect to a central front-to-rear direction thereof and may include a first arm extending generally rearward at the toe side of the ball striking face portion and a second arm extending from the arm of the ball striking face body member generally in the heel-to-toe direction. Additionally, if desired, an enclosed open space or through-hole may be defined between the rear body member and the ball striking face body member.

The rear body member may have a variety of different structures and constructions without departing from this invention. As some more specific examples, the rear body member may include a central body portion and an outer cover material that covers at least a majority of the central body portion. This outer cover material may include a rubber or other polymeric material doped with a weighting material having a higher density than the rubber or polymer material (e.g., doped with lead, tungsten, materials containing lead and/or tungsten, powders containing tungsten or lead, etc.). A first fastener may engage a first end of the central body portion (e.g., at the toe end of the ball striking face member) and a second fastener may engage a second end of the central body portion (e.g., at the arm portion of the ball striking face member).

Still other aspects of this invention relate to putter heads that have a putter head body including a ball striking face portion and a rear body portion (formed from one or more parts), wherein the putter head body has an overall breadth dimension B in a front-to-rear direction and a depth of a center of gravity in the front-to-rear direction $D_{CG}$, wherein a ratio of $D_{CG}/B$ is at least 0.425, and in some examples, at least 0.45, at least 0.48, at least 0.5, at least 0.51, and even at least 0.52. In some examples of this aspect of the invention, the putter heads will have an overall front-to-rear dimension of at least 2 inches, and in some examples at least 2.25 inches, or even at least 2.5 inches. Such putter head structures also may define an enclosed open area or through hole (e.g., defined between a rear of the ball striking face portion and the rear body portion). The ball striking face portion and the rear body portion also may be formed as independent parts, e.g., a rear body member and a ball striking face member having the various characteristics described above. Also, the rear body member may have a greater mass than the ball striking face member.

Additional aspects of this invention relate to putter heads that include: (a) a ball striking head body member including a rearwardly extending body support having an opening defined therein; and (b) a rear body member having a first end engaged at a toe side of the ball striking head body member, a second end engaged at a heel side of the ball striking head body member, and a central portion between the first end and the second end extending through the opening in the ball striking head body member. The ball striking head body member may include a first rearward extending arm at the heel side and a second rearward extending arm at the toe side, wherein the rear body member is engaged with the first and second rearward extending arms. In some more specific examples of this aspect of the invention, the first rearward extending arm of the putter head will include (a) a first portion extending rearwardly and substantially perpendicular to a ball striking face of the ball striking head body member and (b) a second portion extending rearward from the first portion at an angle (an obtuse angle) to a location outside a heel edge of the ball striking face, and the second rearward extending arm will include (a) a first portion extending rearwardly and substantially perpendicular to the ball striking face and (b) a second portion extending rearward from the first portion of the second rearward extending arm at an angle (an obtuse angle) to a location outside a toe edge of the ball striking face.

Putter heads according to still other examples of this invention may include: (a) a ball striking head body member; and (b) a rear body member having a first end engaged at a toe side of the ball striking head body member, a second end engaged at a heel side of the ball striking head body member, and a central portion between the first end and the second end, wherein the central portion includes a forwardly projecting platform that includes an alignment aid thereon. Optionally, the ball striking head body member also may include a rearward projecting platform that includes an alignment aid thereon. The alignment aid of the central portion of the rear body member (e.g., a projection) may align with the alignment aid of the rearward projecting platform (e.g., a notch) of the ball striking head body member. In this example structure, the ball striking head body member may include a first rearward extending arm at the heel side and a second rearward extending arm at the toe side. The first rearward extending arm may extend rearwardly from a ball striking face of the ball striking head body member at an angle to a location outside a heel edge of the ball striking face. Also, the second rearward extending arm may extend rearwardly from the ball striking face at an angle to a location outside a toe edge of the ball striking face.

As yet another example, putter heads according to at least some aspects of this invention may include: a ball striking head body member including: (a) a first rearward extending arm at a heel side of the ball striking head body member, wherein the first rearward extending arm extends rearwardly from a ball striking face of the ball striking head body member at an angle to a location outside a heel edge of the ball striking face, and (b) a second rearward extending arm at a toe side of the ball striking head body member, wherein the second rearward extending arm extends rearwardly from the ball striking face at an angle to a location outside a toe edge of the ball striking face. Such putter heads further may include a rear body member having a first end engaged with the first rearward extending arm and a second end engaged with the second rearward extending arm, wherein the rear body member includes a rubberized tungsten material and optionally a stainless steel material.

Still another example aspect of this invention relates to putter heads that include: (a) a ball striking head body member; and (b) a rear body member having a first end engaged at a heel side of the ball striking head body member and a free second end that is not engaged with any portion of the putter head (e.g., hanging free, not engaged with the ball striking head body member). Optionally, if desired, a rear portion of the ball striking head body member may include a rearward projecting platform that extends to a heel side of the rear body member. The ball striking head body member may include a rearward extending arm at a heel side that optionally extends rearwardly from a ball striking face of the ball striking head body member at an angle to a location outside a heel edge of the ball striking face. A gap between the free second end of the rear body member and a rear surface of the ball striking head body member provides an opening to an open space defined between the ball striking head body member and the rear body member.

Additional aspects of this invention relate to putting systems or kits that may include various interchangeable parts (to make any of the various putter head constructions described above). As one example, such a putting system may include: (a) one or more ball striking face body members each including a ball striking face having a central portion for contacting a ball during a putting stroke, wherein, optionally, the central portion includes a plurality of openings defined therein; (b) optionally, a polymeric material having a majority thereof located behind an exterior surface of the ball striking face, wherein a portion of the polymeric material is exposed at the exterior surface of the ball striking face through the plurality of openings; (c) a first rear body member removably engagable with the ball striking face body member; (d) a second rear body member removable engagable with the ball striking face body member, wherein the first rear body member differs from the second rear body member in at least one manner selected from the group consisting of: weight, weight distribution, material, color, texture, balance, graphics, and shape; and (e) a shaft engagable with at least one of the ball striking face members and the rear body members. The various parts of the putting system may have any of the more specific characteristics or features described above.

Additional aspects of this invention relate to putting devices (such as putters or putter heads) that include: (a) a ball striking face body member including a ball striking face having a central recess defined therein; (b) an insert engaged within the central recess of the ball striking face body member, the insert including a polymeric base material, wherein a plurality of depressions are defined in an exposed surface of the polymeric base material, wherein at least some of the plurality of depressions include an edge element mounted therein to thereby provide a ball striking surface of the putter head with grooves defined therein between edges of the depressions and adjacent edges of the edge elements mounted within the depressions; (c) a rear body member removably engaged with the ball striking face body member; and (optionally) (d) a shaft engaged with at least one of the ball striking face body member and the rear body member. These putting devices may have any of the other characteristics or features described above, including, for example, any of the above noted features of the ball striking face body member, the rear body member, and rear body member interchangeability.

Still additional aspects of this invention relate to methods of making putting devices, e.g., of the various types described above. Such methods may include: (a) providing a ball striking face body member including a ball striking face having a central portion for contacting a ball during a putting stroke, wherein the central portion optionally includes a plurality of openings defined therein; (b) optionally providing a polymeric material behind at least the central portion of the ball striking face, wherein a portion of the polymeric material (when present) is exposed at an exterior surface of the ball striking face through the plurality of openings; and (c) removably engaging a rear body member with the ball striking face body member. Other example methods according to aspects of this invention may include: (a) providing a ball striking face body member including a ball striking face having a central recess defined therein; (b) engaging an insert within the central recess of the ball striking face body member, the insert including a polymeric base material, wherein a plurality of depressions are defined in an exposed surface of the polymeric base material, wherein at least some of the plurality of depressions include an edge element mounted therein to thereby provide a ball striking surface of the putter head with grooves defined therein between edges of the depressions and adjacent edges of the edge elements mounted within the depressions; and (c) removably engaging a rear body member with the ball striking face body member.

Finally, still additional aspects of this invention relate to methods of changing one or more characteristics of a putting device (e.g., of the types described above) that include: (a) disengaging a first rear body member from the ball striking face body member; and (b) engaging a second rear body member with the ball striking face body member, wherein the first rear body member differs from the second rear body member in at least one manner selected from the group consisting of: weight, weight distribution, material, color, texture, balance, graphics, and shape. Such aspects of the invention allow users to customize the putter head to better match their putting strokes, to better suit their eye, to better conform to their preferences, etc.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of putters, components thereof, and methods in accordance with examples of this invention. When the same reference number appears in more than one drawing, that reference number is used consistently in this specification and the drawings to refer to the same or similar parts throughout.

Figure 1B:
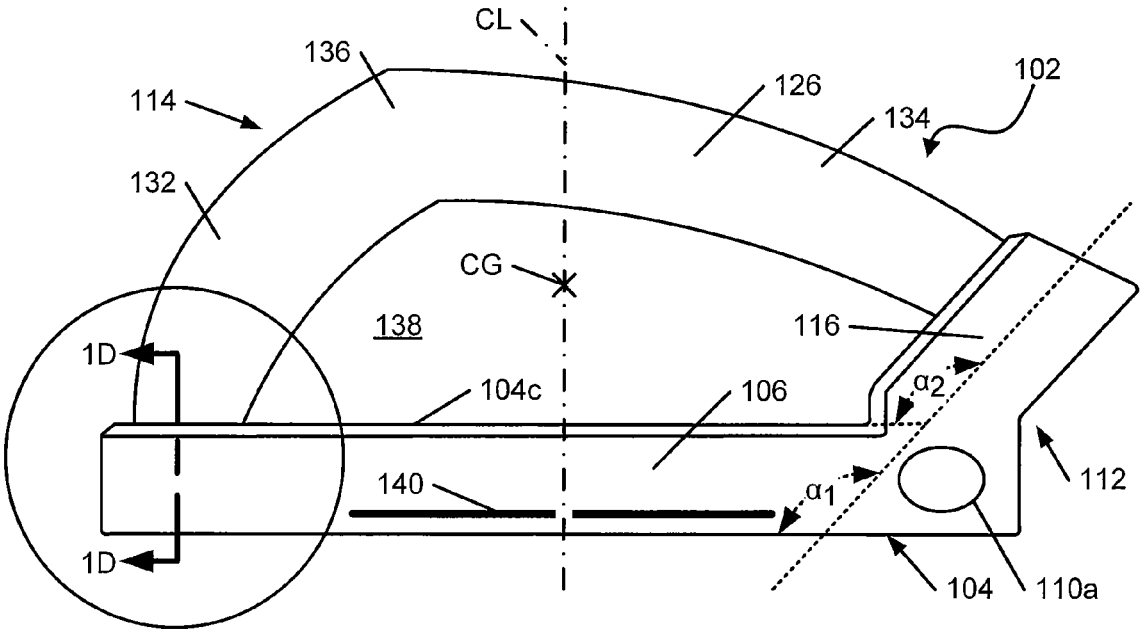

FIGS. 1A through 1D illustrate one example putter structure 100 in accordance with this invention. The putter 100 includes a putter head 102 having a ball striking face 104, a top surface 106 (visible when looking down at the putter head 102 at a ball address position, e.g., as shown in FIG. 1B), a bottom portion 108 (not visible when looking from at the putter head 102 at the ball address position), and a shaft member 110 engaged with the putter head 102. The putter head 102 may be constructed from one or more parts and may be made from any desired materials (or combinations of materials) without departing from this invention, including, for example, metals, metal alloys (such as stainless steel), and the like, including materials that are conventionally known and used in the art. The various parts of this example putter head 102 (e.g., the ball striking face body member 112 and the rear body member 114) will be described in more detail below. Likewise, the shaft member 110 may be made of any desired materials without departing from this invention, including, for example, metals, metal alloys, composites, and the like, including materials that are conventionally known and used in the art.

In the illustrated structure, the shaft member 110 engages the putter head 102 in the heel region of the ball striking face body member 112, but other arrangements are possible, such as center shafting etc. Also, while the illustrated example shows the shaft member 110 extending into an opening or hole 110*a* formed in the top surface 106 of the ball striking face body member 112, any desired type of engagement of the shaft 110 with the ball striking face body member 112 and/or the rear body member 114 may be possible without departing from this invention, including engagement via an external hosel member engaged or integrally formed with one or more parts of the putter 102 structure. Putter heads in accordance with this invention also may be face balanced or otherwise balanced.

As illustrated in FIG. 1A, the front, exterior ball striking face 104 of this example putter head 102 includes at least two different surface features. One portion of the ball striking face 104, the ball striking face member 104*a*, may be contiguous or integral with the front surface of the ball striking face body member 112, and this ball striking face member 104*a* may be made from any of the materials described above for the putter head 102 or other conventional materials used for putter ball striking faces (e.g., aluminum (or alloys thereof), etc.). As another example, the ball striking face member 104*a* may be a portion of a face insert member (e.g., made from aluminum or an aluminum alloy). Another portion of the exposed ball striking surface 104 is made from a polymeric material 104*b*. In at least some example structures in accordance with this invention, the polymeric material 104*b* generally will be softer and more lightweight (e.g., less dense) as compared to the material of the remainder of the ball striking face 104, including the material of the ball striking face member 104*a*. As illustrated in FIG. 1A, in this example structure, these two portions 104*a* and 104*b* of the ball striking face 104 extend across a central portion of the ball striking face 104 of the putter head 102 in an alternating manner, such that a plurality of parallel strips of polymeric material 104*b* are separated by a plurality of strips of the ball striking face member material 104*a*. Examples of the construction of putter heads to include this type of alternating material structure, and other structures including combinations of materials, will be described in more detail below.

One potential advantage of providing a polymeric material (e.g., material 104*b*) within a putter head relates to the potential for weight savings. By removing some of the metal material from the putter head body (e.g., ball striking face body member 112), this material may be replaced by a lighter weight or less dense polymeric material. This weight savings allows the club designer to place additional weight at other areas of the putter head structure, such as toward the rear corners of the putter head structure. Such features may allow the club designer to control and design a club head having a higher moment of inertia (resistance to twisting, e.g., Izz) and desired center of gravity location characteristics. Additionally, by including this relatively soft polymeric material 104*b* as part of the ball striking face 104 (such that the polymeric material 104*b* also directly contacts the ball during a putt) and in the putter head 102, the ball strike characteristics of the putter head 102 may be altered and controlled, which affects the sound, rebound, and other "feel" characteristics of the putter head (e.g., by damping vibrations and altering the sound of a ball strike). The polymeric material 104*b* and/or the junction between the polymeric material 104*b* and the material of the ball striking face member 104*a* also may influence ball spin and/or launch as the ball comes off the putter face. These features will be described in more detail below.

The example putter head structure 102 of FIGS. 1A through 1D includes the ball striking face member 104*a* engaged with the ball striking face body member 112 with a layer of polymeric material 104*b* sandwiched between the ball striking face member 104*a* and the ball striking face body member 112. The ball striking face body member 112 may constitute one or more pieces that are engaged together to form a main portion of the putter head ball striking face, and this ball striking face body member 112 may be made from any desired materials (or combinations of materials) without departing from this invention, including, for example, metals, metal alloys (such as stainless steel), polymeric materials, and the like, including materials that are conventionally known and used in the art. If desired, some portions of the ball striking face body member 112 (including portions of the face 104) may be made from aluminum or aluminum alloy materials (e.g., having a density of about 2.5 g/cc) or some parts (including at least some portions of the face 104) may even be made from stainless steels, polymers, carbon fiber reinforced materials, and/or other fiber reinforced materials.

Figure 1C:
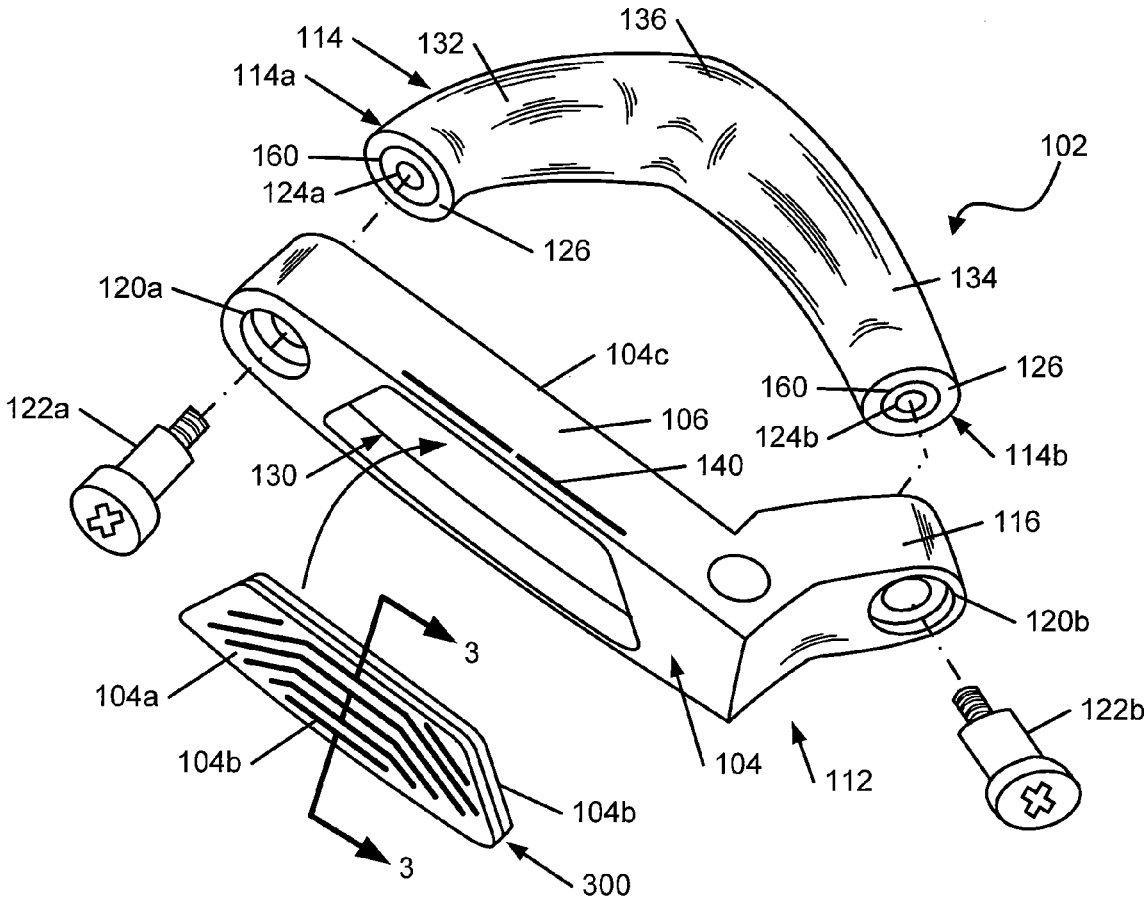

Other features of this example putter head structure 102 enable easy customization and fitting of the putter to the user's personal tastes and putting stroke. As shown in FIGS. 1A through 1C and noted above, this example putter head 102 includes at least two parts (each of which itself may be made from multiple parts). The first part is the main ball striking face body member 112 mentioned above, and the second part is the rear body member 114 that is releasably engaged with the ball striking face body member 112. In the illustrated example, the ball striking face body member 112 includes the ball striking face 104 (which, in this example, is made from multiple parts) and an arm 116 that extends rearward at one side (at the heel side or shaft attachment area, in this example) of the ball striking face 104. As shown, the arm 116 extends rearward at an oblique angle $\alpha_1$ with respect to the front ball striking face 104 and, in this illustrated example, at an oblique angle $\alpha_2$ with respect to a rear surface 104*c* of the ball striking face 104. These obtuse angles $\alpha_1$ and $\alpha_2$, which are measured based on the arm 116's center line (as shown in FIG. 1B), may be the same or different and may be within a range of 100° to 170°, and in some examples, within a range of 110° to 160°, or even within a range of 120° to 150°. The arm 116 may be integrally formed with the front of the ball striking face body member 112, or these elements may be separate parts engaged together.

The ball striking face body member 112 of this example structure includes two openings defined therethrough to enable attachment of the rear body member 114 to the ball striking face body member 112. One opening 120*a* is provided at the toe region of the ball striking face 104, and the other opening 120*b* is provided at a free end of the arm 116. Fasteners 122*a* and 122*b* extend through the openings 120*a* and 120*b*, respectively, and engage interior structures 124*a* and 124*b*, respectively, provided at the ends (114*a* and 114*b*) of the rear body member 114 to thereby engage the rear body member 114 to the ball striking face body member 112. While any desired types of fasteners and engagement structures may be used without departing from this invention, in this illustrated example, fasteners 122*a* and 122*b* included threaded ends that engage threaded openings provided in the ends of the rear body member 114. Turnbuckles, spring loaded fasteners, or other fastening mechanisms also may be used for these connections without departing from this invention (and the fastener system at the ball striking face 104 toe end need not have the same construction as the fastener system at the arm 116 location).

Figure 1D:
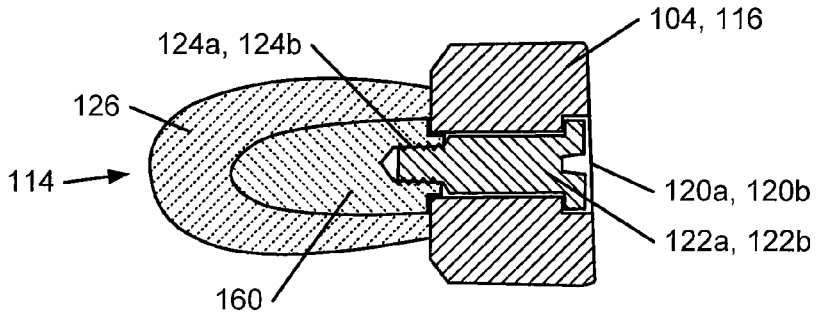

FIG. 1D shows a partial cross sectional view of the example releasable connections used in this example golf club head structure 102. As shown in FIGS. 1C and 1D, at least the end portions 114*a* and 114*b* of the rear body member 114 include threaded interior structures 124*a* and 124*b* for engaging the fasteners 122*a* and 122*b*, respectively. If desired, the interior structures 124*a* and 124*b* may be provided on opposite ends of a single element 160 that extends through an entire interior of the rear body member 114. More specifically, if desired, a metal cylinder or bar 160 (e.g., aluminum, titanium, brass, copper, nickel, steel, beryllium, or mixtures or alloys thereof) with interior threaded ends may extend from one end 114*a* of the rear body member 114 to the other end 114*b*. Alternatively, just the ends 114*a* and 114*b* may include the additional structure (with interior structures 124*a* and 124*b* for engaging the fasteners 122*a* and 122*b*, respectively), e.g., as shorter cylinders or bars 160. If desired, structure(s) 160 may be covered with another material 126, such as an outer sheath made from rubber, plastic, foam, metal, or other materials. This outer cover material 126 may be hard, soft, textured, or otherwise formed in any desired manner without departing from this invention. In some more specific example constructions according to this invention, the outer cover material 126 (or the entire rear body member 114) may include a rubber material having tungsten (or tungsten oxide) dispersed in it (also called a "rubberized tungsten" material herein, e.g., having a density of about 8 g/cc). As additional examples, if desired, the outer cover member 126 or the entire rear body member 114 may be made of other weighted plastic materials, such as polyurethanes, TPUs, or other polymers doped with lead or tungsten (e.g., polymers doped with lead or tungsten containing powders) to increase their density and weight. As another alternative, if desired, this outer cover material 126 may be omitted and the rear body member may constitute the one or more parts that form or connect the fastening structures 124*a* and 124*b*.

The rear body member 114 of this example structure includes a first arm portion 132 extending rearward at the toe of the ball striking face 104 and a second arm portion 134 extending from the arm 116 of the ball striking face body member 112. The first arm portion 132 extends generally rearward and somewhat toward the putter head's heel direction, and the second arm portion 134 extends generally toward the putter head's toe direction and somewhat toward the rear of the club head 102. While the rear body member 114 may have any desired shape, in this example, the two arms 132 and 134 are somewhat curved and meet at an elbow area 136. The elbow area 136 may be curved or angular (or otherwise shaped) without departing from this invention.

The rear body member 114 (and any individual part thereof, such as internal structures 124*a*, 124*b*, and/or cover material 126) may be weighted in any desired manner to thereby provide different overall weights, weight distributions, balance characteristics, etc. Additionally or alternatively, if desired, additional separate weight members may be incorporated into the rear body member 114 structure. These additional weights may be separately engaged with the rear body member 114 (and optionally releasably engaged, to thereby allow interchange of weights on the rear body member 114), engaged with or formed as part of the interior structure 160 of the rear body member 114, engaged with one or more weight ports provided on the rear body member 114 (e.g., provided in cover material 126), etc. These removable weight features also may allow for at least some customization and fitting of the putter to a specific user's tastes and/or putting stroke characteristics.

If desired, the outer cover material 126 may be removable from its internal structure 160 (e.g., fastener element structures 124*a* and 124*b*) to allow one cover material 126 to be interchanged for another (e.g., to provide different weights, different weight distributions, weight balancing, colors, graphics, shapes, materials, textures, etc.) without completely detaching the rear body member 114 from the ball striking face body member 112. This may be accomplished, for example, if the outer cover material 126 is a flexible material (such as rubber, foam, textile, etc.) that can be peeled off and fit around the internal structures 124*a* and/or 124*b*. This feature may allow interchange of rear body members 114 by replacing just a portion of the overall rear body member.

As shown in FIGS. 1A, 1C, and 1D, the openings 120*a* and 120*b* may include features to allow the heads of the fasteners 122*a* and 122*b* to lie flush with or be countersunk into the surfaces of the ball striking face body member 112. This feature, however, is not a requirement in all embodiments of the invention.

FIGS. 1A and 1C further illustrate that in this example structure according to the invention, at least a central portion of the ball striking face 104 is provided as an insert member 300 that is engaged within an opening or recess 130 defined in the front or exterior surface of the ball striking face body member 112. Features of the insert member 300 and/or other aspects of the exterior surface of the ball striking face 104 (particularly in the central portion of the ball striking face 104) will be described in more detail below.

Additional features of this example putter head 102 are illustrated in FIGS. 1A through 1C. For example, in at least some example structures according to this invention, the rear body member 114 and the ball striking face body member 112, when engaged together, define an enclosed open space 138 (or a through-hole). This is not a requirement. Alternatively, if desired, one or more structures may be provided to close up this open space 138, and optionally, an alignment aid, graphics, or other information may be provided in this central area. Also, as shown in these figures, the rear body member 114 may be non-symmetric, e.g., when engaged with the ball striking face body member 112, the rear body member 114 may be non-symmetric with respect to a front-to-rear center line CL of the putter head 102 (see FIG. 1B—non-symmetric with respect to a front-to-rear center line through the overall putter head's center of gravity (CG) or with respect to the geometric center of the front exterior surface of the ball striking face (e.g., through the putter head's "sweet spot")). The elbow area 136 of the rear body member 114 of this example is located on the toe side of the center line CL. In the illustration of FIG. 1B, the overall putter head's center of gravity is marked by an "x". The location of the center of gravity (CG) may be altered, for example, by changing one rear body member 114 for another, as will be described in more detail below in conjunction with FIGS. 2A and 2B. This example structure can be used to provide the center of gravity CG at a deep location relative to the putter head's front-to-rear direction, if desired.

FIGS. 1A through 1C further illustrate an alignment aid 140 on the top surface 106 of the ball striking face body member 112. Any desired type of alignment aid may be provided without departing from this invention, including, for example, alignment aids of conventional structure and appearance as are known and used in this art.

Figure 2A:
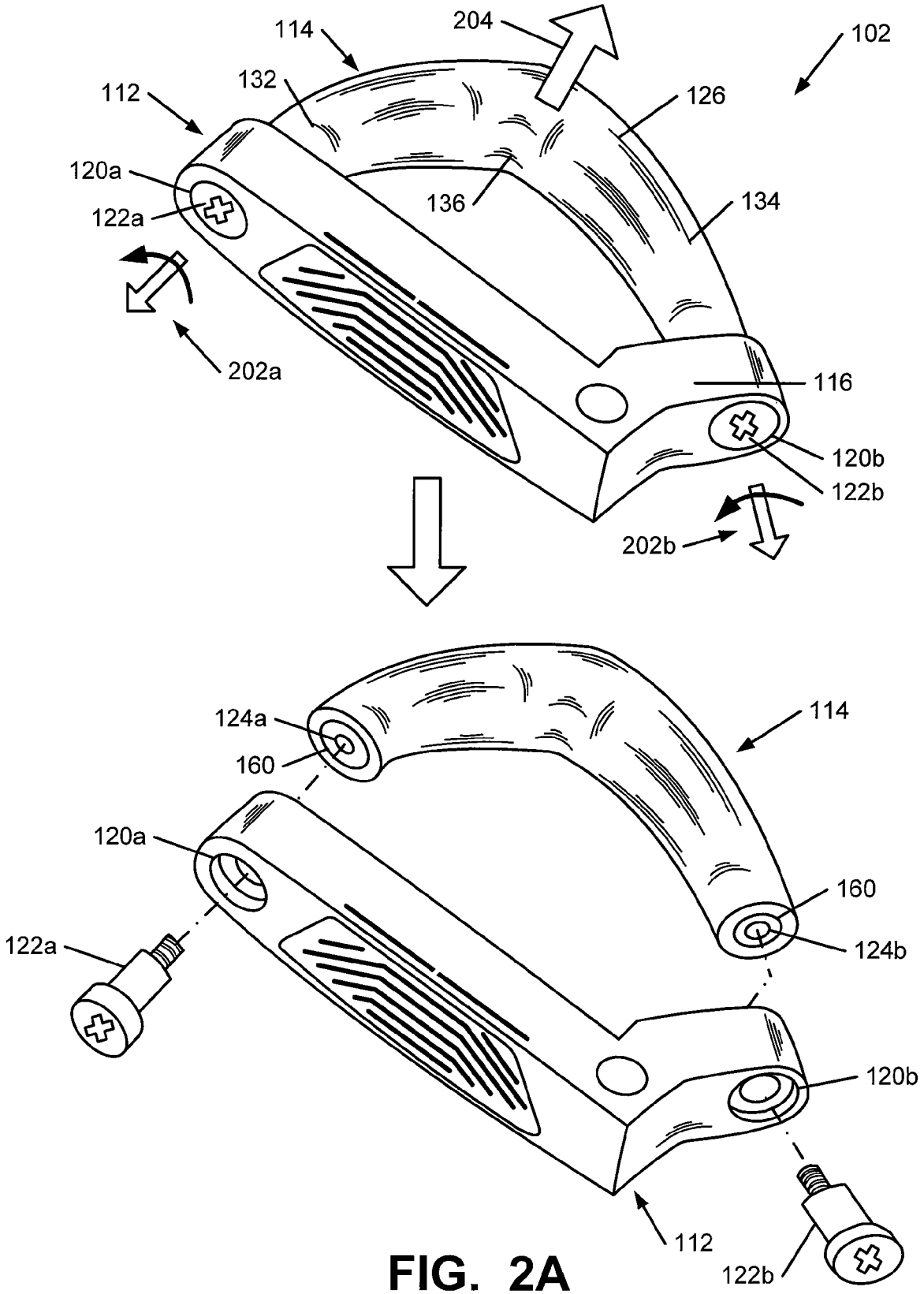
FIGS. 2A and 2B illustrate various assembly and interchangeability features of putter head structures in accordance with some aspects of this invention.
Figure 2B:
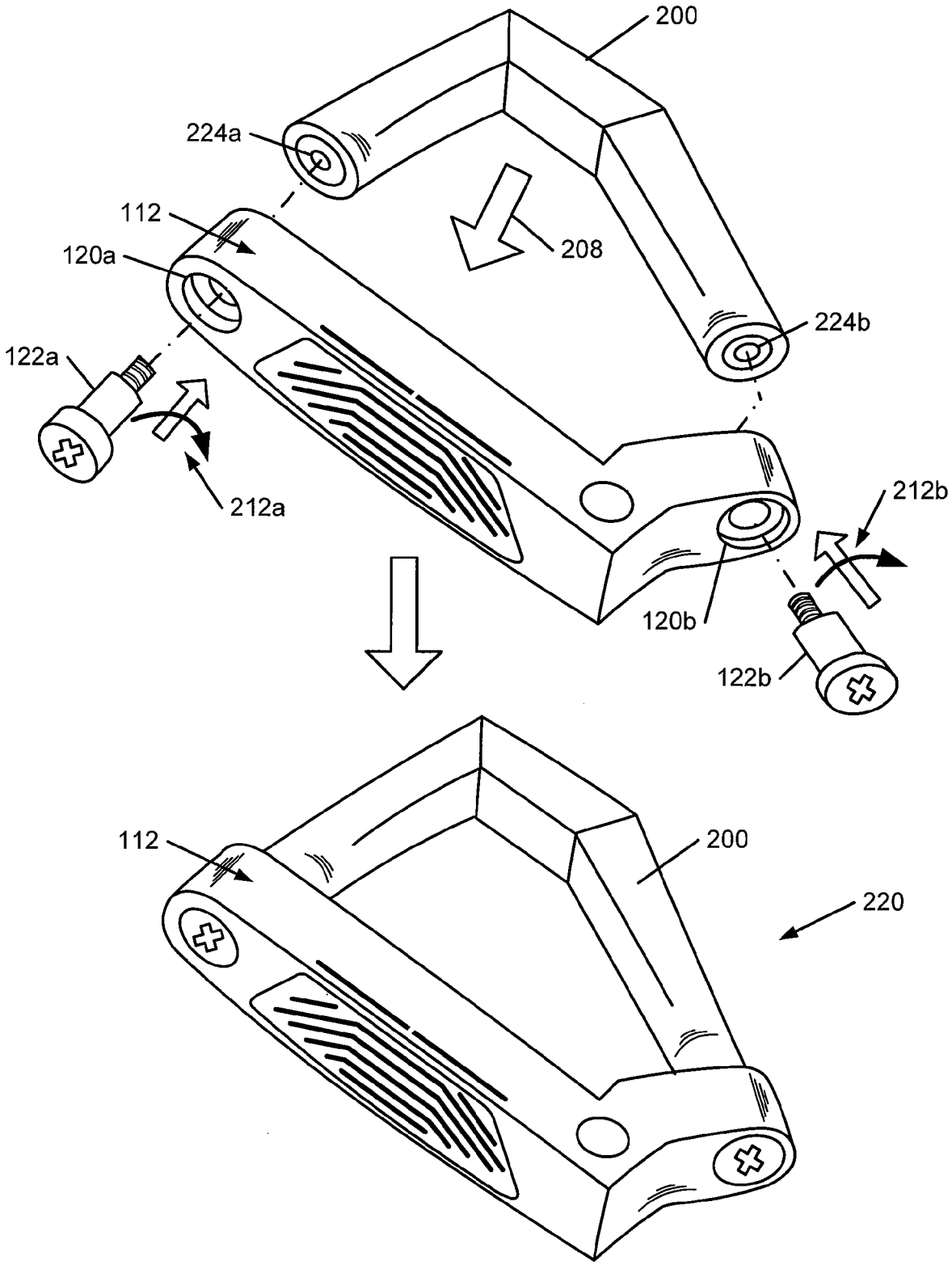

FIGS. 2A and 2B illustrate one example of a method of changing the characteristics of a putter head 102 by exchanging one rear body member 114 (FIG. 2A) for another rear body member 200 (FIG. 2B). As shown in FIG. 2A, in this example method, first the rear body member 114 is removed from the ball striking face body member 112. This is accomplished in this example by disengaging the fasteners 122*a* and 122*b* from the securing structures 124*a* and 124*b* in the rear body member 114. Because this is a threaded engagement in the specific example shown in FIG. 2A, the fasteners 122*a* and 122*b* are disengaged by twisting them (e.g., using a screwdriver, an Allen wrench, or other tool) and pulling them outward and away from the ball striking face member 112, as shown by the arrows 202*a* and 202*b* in FIG. 2A. This action allows the rear body member 114 to be pulled away from the ball striking face body member 112, as shown by arrow 204 in FIG. 2A. The bottom of FIG. 2A shows the rear body member 114 separated from the ball striking face body member 112.

FIG. 2B shows example steps involved in this example process in attaching a new rear body member 200 to the ball striking face body member 112. First, a new rear body member 200 is selected and moved into place near the rear sides of the mount openings 120*a* and 120*b*. This is generally shown in FIG. 2B by arrow 208. Then, the fasteners 122*a* and 122*b* are engaged with the structures 224*a* and 224*b*, respectively, provided in the new rear body member 200, as shown generally in FIG. 2B by arrows 212*a* and 212*b*. This action engages the new rear body member 200 with the ball striking face body member 112 and provides the final, new putter head structure 220 shown at the bottom of FIG. 2B.

The new rear body member 200 can change the characteristics of the putter head 220 in any desired manner without departing from this invention. While the changes may be purely aesthetic (e.g., color changes, shape changes, graphics changes or additions, personalized information inclusion, texture changes, etc.), the changes also may affect performance or feel characteristics of the putter head, such as weight, weight distribution, materials, center of gravity location, moment of inertia characteristics, balance characteristics, sound or vibration dampening, etc. Optionally, if desired, the fasteners 122*a* and/or 122*b* also may be changed, and this action also may provide different characteristics to the putter head (e.g., different weighting, weight distribution, etc.).

As another option, if desired, rather than swapping out the entire rear body member 114 for another (e.g., rear body member 200), only a portion of the rear body member 114 needs to be changed. For example, if desired, one outer member 126 may be swapped for another, optionally while a portion of the rear body member 114 remains attached to the ball striking face body member 112. This can be accomplished, for example, if the outer member 126 is releasably engaged with its internal mount structure(s) 160.

Figure 3A:
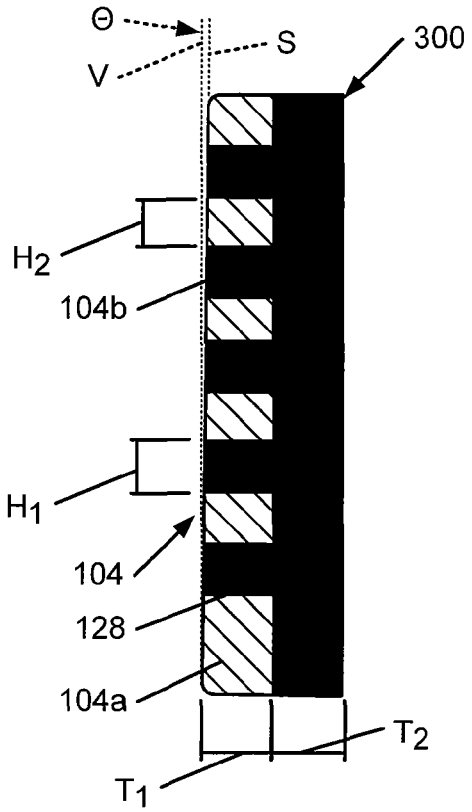
FIGS. 3A through 3F illustrate various example ball striking face features of putter head structures in accordance with some aspects of this invention.

FIGS. 3A through 3F illustrate additional details of putter head structures 102 in accordance with at least some examples of this invention. In the perspective view of FIG. 1C, an insert member 300 is shown, and FIGS. 3A through 3F illustrate various cross sectional views of example insert member 300 taken along line 3-3 in FIG. 1C. As shown in FIG. 3A, like FIGS. 1A and 1C above, the central portion of the ball striking face 104 of the putter head 102 (formed as insert member 300 in this illustrated example) includes two distinct portions 104*a* and 104*b*, namely, a portion made up of the material making the ball striking face member 104*a* and a portion made from exposed polymeric material 104*b*. The polymeric material portion 104*b* is filled into openings (e.g., slots) 128 defined in the ball striking face member 104*a* of the insert 300. The openings 128 may be formed in the ball striking face member 104*a* in any desired manner without departing from this invention, including, for example, by forming the ball striking face member 104*a* to include such openings 128 (e.g., during the molding, casting, forging, or other production process), by machining such openings 128 into the ball striking face member 104*a* (e.g., punching, stamping, or cutting them through a plate, etc.), etc. Any desired number of openings 128 may be provided in a ball striking face member 104*a* without departing from this invention.

The openings 128 expose the polymeric material 104*b* and allow it to extend to an exterior surface of the ball striking face 104 (i.e., positioned to contact the ball during a putt). A variety of different face constructions are possible without departing from this invention, and several examples are described in more detail below (in this illustrated example, the polymeric material 104*b* is a separate layer of the insert 300 provided behind the ball striking face member 104*a*).

As shown in FIG. 3A, the exterior surface of the ball striking face 104 includes both the metal (or other) material of the ball striking face member 104*a* and the exposed polymeric material 104*b* present in the openings 128 defined in the ball striking face member 104*a*. The openings 128 (and thus the height of the exposed polymeric material 104*b* in the top-to-bottom direction on the ball striking face 104) may be made any desired size without departing from this invention. For example, these openings 128 (and thus the height $H_1$ of the exposed polymeric material 104*b*) may be in the range of 0.03 to 0.5 inches, and in some examples, from about 0.1 to 0.3 inches. Likewise, the height of the metal (or other) material 104*a* between adjacent openings 128 (and thus the height $H_2$ between adjacent portions of the polymeric material 104*b*) may be made any desired size without departing from this invention. For example, the height $H_2$ may be in the range of 0.03 to 0.5 inches, and in some examples, from about 0.1 to 0.3 inches. The heights $H_2$ between adjacent openings 128 may be less than, equal to, or greater than the heights $H_1$ of the polymeric material portions 104*b* in a given putter head structure. Additionally, the heights $H_1$ and $H_2$ may be of a constant size or of different sizes in a given putter head structure without departing from this invention. The heights $H_1$ and $H_2$ also may change over the course of the length of the individual openings 128 and/or the spaces between the openings 128 (e.g., in a heel-to-toe direction of the putter ball striking face 104). A wide variety of potential combinations of sizes and arrangements of the various portions 104*a* and 104*b* are possible.

The thicknesses $T_1$ and $T_2$ of the ball striking face member 104*a* and the polymeric material 104*b*, respectively, also may vary without departing from this invention. As more specific examples, these thicknesses $T_1$ and $T_2$ may be the same or different and may range, for example, from 0.1 to 2 inches, and in some examples, from about 0.25 to 1 inch.

As further illustrated in FIG. 3A, the exterior surface of the ball striking face 104 may be smooth (e.g., the portions 104*a* and 104*b* may smoothly transfer from one portion to the next in the alternating portion of the surface). The ball striking face 104 may be flat, or it may include some roll or bulge characteristics, and/or it may have some desired loft characteristic. In this illustrated example, the putter ball striking face 104 will have a loft angle Θ of 3° or less, and in some examples, the angle Θ may be 2.5° or less or even 2° or less. The loft angle Θ corresponds to the angle of the exterior ball striking face surface S (with the putter head at a ball address position) with respect to a vertical line V.

Figure 3B:
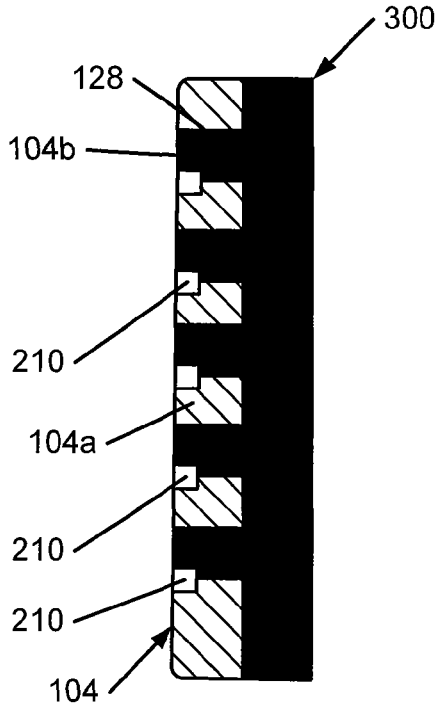
Figure 3C:
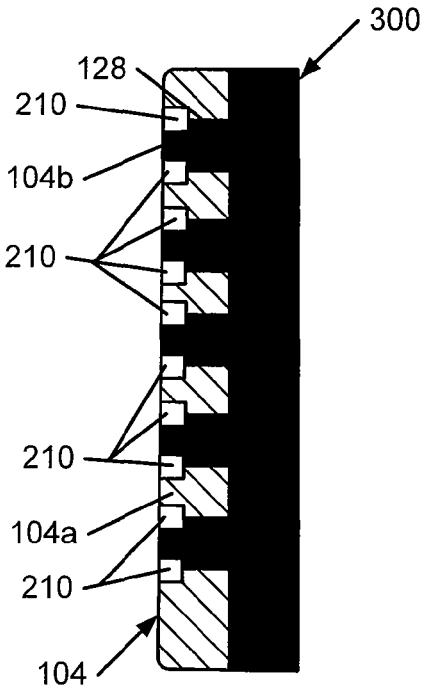

A flat and/or smooth exterior surface of the ball striking face 104 is not a requirement. To the contrary, as illustrated in FIGS. 3B through 3E, the ball striking face 104 may include one or more grooves or scorelines 210 formed therein. As illustrated in the example structures of FIGS. 3B and 3C, the grooves 210 may be formed at an area of the ball striking face 104 bridging at least some of the junctions between the metal ball striking face member 104*a* and the exposed polymeric material 104*b* such that the grooves 210 are provided partially in each of these materials 104*a* and 104*b*. The grooves 210 may be integrally formed in the portions 104*a* and 104*b* when the various parts of the ball striking face 104 are formed (e.g., during the molding, casting, forging, or other forming process), and/or they may be formed at a later time (e.g., after the polymeric material 104*b* is placed in the ball striking face body member 112, e.g., by a cutting or machining process). FIG. 3B illustrates an example insert member 300 in which the grooves 210 are formed at the junctions of the bottom of a polymeric portion 104*b* and the top of the adjacent metal portion 104*a*. If desired, this structure could be flipped such that the grooves 210 are formed at the junctions of the top of a polymeric portion 104*b* and the bottom of the adjacent metal portion 104*a*. FIG. 3C, on the other hand, illustrates another example insert member 300 in which the grooves 210 are formed: (a) at the junctions of the bottom of a polymeric portion 104*b* and the top of the adjacent metal portion 104*a* and (b) at the junctions of the top of a polymeric portion 104*b* and the bottom of the adjacent metal portion 104*a*. In other words, in the structure of FIG. 3B, at least some of the metal portions 104*a* and the polymeric portions 104*b* have a single groove 210 defined therein, whereas in the structure of FIG. 3C, at least some of the metal portions 104*a* and the polymeric portions 104*b* have two grooves 210 defined therein (one groove at their top and one groove at their bottom).

Providing grooves or scorelines (e.g., like grooves 210) can affect the manner in which the ball leaves the putter ball striking face 104 during the course of a putt. For example, the grooves 210 can affect launch angle and/or ball spin as the ball leaves the putter ball striking face 104 during a putt. As one more specific example, in at least some instances, the grooves 210 and the polymeric material 104*b* will grip the ball somewhat and produce top spin on the ball when putted (particularly if the ball is struck with somewhat of an ascending blow), which tends to get the ball rolling earlier and truer (e.g., and may eliminate some early bouncing during a putt).

The grooves 210 may have any desired height without departing from this invention. For example, if desired, the grooves 210 may extend up to 10% of the height of the portion 104*a* and/or 104*b* into which it is provided, and in some examples, up to 25% or even up to 50% or 75% of this height. The grooves 210 may extend into the portions 104*a* and/or 104*b* (in the front-to-rear or depth direction), for example, a distance of about 0.25 to 2 times the groove's height, and in some examples, from 0.5 to 1.5 times the groove's height. The grooves 210 also may have any desired cross sectional shape in the top-to-bottom and front-to-rear directions, such as U-shaped, V-shaped, C-shaped, etc. The various grooves 210 on a putter ball striking surface 104 may have the same or different sizes and/or shapes, and every junction and/or every portion 104*a* and/or 104*b* on a given putter structure need not include an associated groove 210.

Figure 3D:
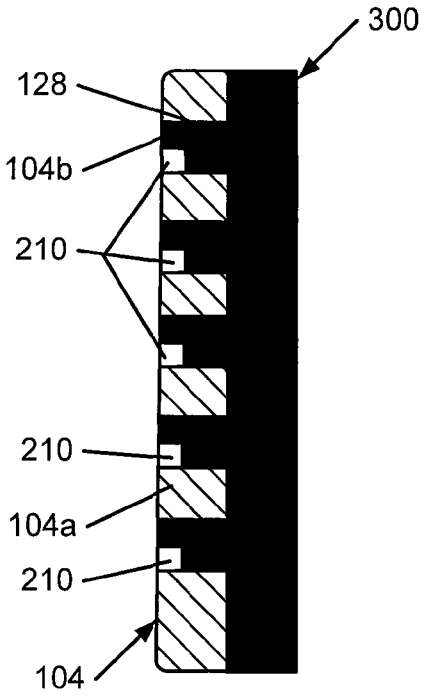
Figure 3E:
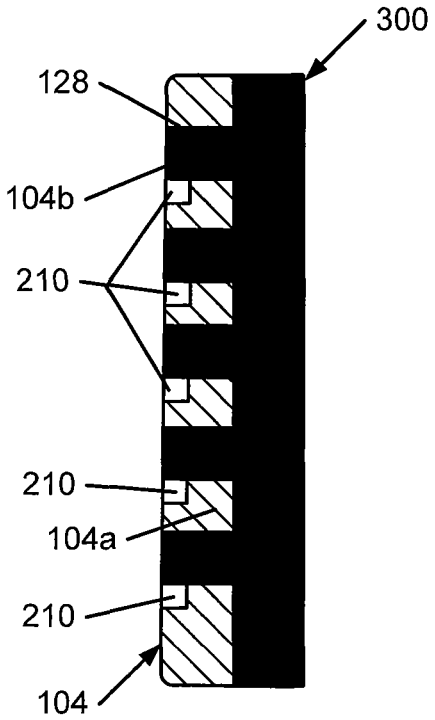

The grooves 210 may have other constructions or arrangements without departing from this invention. For example, as illustrated in FIG. 3D, the grooves 210 may be formed solely in the material making up the polymeric portion 104*b* of the ball striking face 104. Alternatively, as illustrated in FIG. 3E, the grooves 210 may be formed solely in the material making up the metal (or other base material) portion 104*a* of the ball striking face 104. As yet another example, if desired, grooves 210 of the types illustrated in FIGS. 3B, 3C, 3D, and/or 3E may be combined in a single putter head structure without departing from this invention. Also, if desired, in the structures of FIGS. 3D and 3E, grooves 210 may be provided at either the tops or the bottoms of the polymeric portions 104*b* (FIG. 3D) or the metal portions 104*a* (FIG. 3E), without departing from this invention.

Figure 3F:
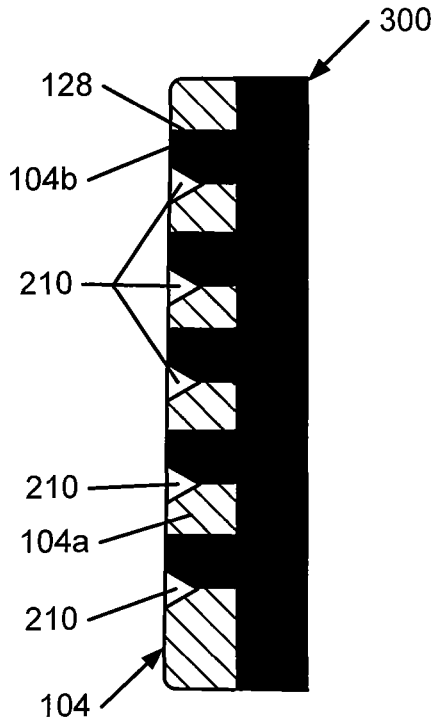

While FIGS. 3B through 3E illustrate grooves 210 have rectangular or "box" shaped cross sections, this is not a requirement. Other groove cross sectional shapes may be used without departing from this invention. For example, as shown in FIG. 3F, in this example structure 300 according to the invention, the grooves 210 have a "V-shaped" cross sectional configuration. While illustrated as being formed in both the metal (or other) base material portion 104*a* and the polymeric portion 104*b* in this example structure, V-shaped grooves of this type may be formed in only one of these portions 104*a* or 104*b* without departing from this invention. In some example structures according to this invention, the top edge of the groove 210 will be defined by the material of one of the portions (e.g., portion 104*b*) and the bottom edge of the groove 210 will be defined by the material of the other portion (e.g., portion 104*a*).

Notably, by making the grooves 210 V-shaped, the angle between the front ball striking face and the groove side wall is not as sharp (e.g., more than 90°, and optionally between 120° and 170°, and in some examples, between 135° and 155°). This less sharp angle may grip the ball somewhat less aggressively (as compared to the 90° box shaped grooves 210), to allow fine tuning of and more control over the ball's typical launch angle and/or rolling characteristics (e.g., to suit an individual player's preferences, typical course conditions, etc.). While V-shaped and box-shaped grooves 210 are illustrated in these figures, other groove cross sectional shapes also may be utilized, such as C-shaped, non-symmetric shapes (e.g., with the top entry angle into the groove different from the bottom entry angle into the groove), etc. Also, if desired, a single ball striking face may have grooves 210 of different cross sectional shapes (e.g., with some grooves box-shaped, some V-shaped, etc.).

V-shaped grooves 210 as shown in FIG. 3F and/or other groove cross sectional shapes may be used in any desired putter head construction without departing from this invention, including the various constructions described above and described in more detail below (in conjunction with FIGS. 1A through 2B and FIGS. 5 through 18B). Additionally, if desired, V-shaped grooves as shown in FIG. 3F and/or other groove cross sectional shapes may be used in any of the putter head constructions described in U.S. Pat. No. 7,717,801; U.S. Pat. No. 7,806,779; U.S. patent application Ser. No. 12/612,236; and U.S. patent application Ser. No. 12/755,330 mentioned above.

In the various structures shown in FIGS. 3B through 3F, the grooves 210 are defined such that one edge of the groove is made of the metal (or other hard) material 104*a* and the opposite edge of that same groove 210 is made of the polymeric material 104*b* (or other softer material). This is not a requirement. Rather, if desired, in accordance with some examples of this invention, the grooves 210 may be formed such that their opposite edges are formed in a single portion 104*a* or 104*b* of the ball striking face 104.

Figure 4:
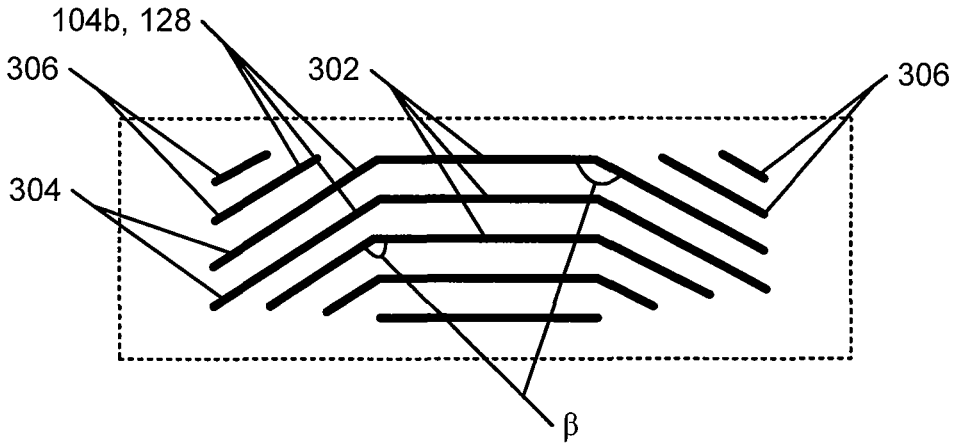
FIG. 4 illustrates additional example ball striking face features of putter head structures in accordance with some aspects of this invention.

The openings 128 on the ball striking face 104 through which the polymeric material 104*b* is exposed also may have a wide variety of configurations without departing from this invention. FIGS. 1A and 4 illustrate the openings 128 (and thus the exposed polymeric material 104*b*) as a plurality of elongated slots that extend across the central portion of the ball striking face 104 (e.g., as part of an insert member 300). More specifically, as illustrated in FIG. 4, in the central portion of the ball striking face 104, a vertically spaced series of generally horizontal linear segments 302 are provided (when the putter is oriented in a ball address position), and on at least some of these horizontal segments 302, slanted, linear, downwardly extending end segments 304 are provided that extend contiguously with the horizontal segments 302. Any desired angle β between the slanted, linear end segments 304 and the horizontal segments 302 may be provided without departing from this invention. In some more specific examples, the angle β may be in the range of 100-170°, and in some structures, between 110-160° or even between 120-150°, and the various angles β within a single putter head may be the same or different without departing from this invention. The transition between segments 302 and 304 may be curved (e.g., rounded), if desired.

In addition, if desired, one or more individual slanted segments 306 may be provided independent of horizontal segments, e.g., at the upper edges of the overall polymeric segment design (running parallel to or substantially parallel to slanted segments 304 associated with a horizontal segment 302). As other alternatives, if desired, the slanted segments 304 and/or 306 may be parallel or non-parallel, may extend upward or downward, may differ in number from those illustrated, may be discontinuous (spaced apart somewhat) from their associated horizontal segment 302 (if any), may all extend downward to a common base line of the putter structure (e.g., to a common horizontal line), may all extend downward to different horizontal locations, etc. In this illustrated structure (as well as the other opening/exposed polymeric material structures described above), grooves may be included in the polymeric material, in the material between the polymeric material, or both, e.g., as described above in conjunction with FIGS. 3B through 3F. The slanted segments 304 and/or 306 (as well as any grooving or scorelines associated therewith), may help keep the ball on the desired line and/or help provide top spin when the ball is hit off-center on the ball striking surface 104.

The presence of contiguous segments is not a requirement. As other examples, the ball striking surface 104 may include multiple sets of separated openings filled with polymeric material. These sets of openings may align with one another or may be offset from one another as one moves across the ball striking surface 104. The sets of openings may extend to a common cavity in the body member, to different cavities, or to no common cavity at all, if desired. Also, if desired, the openings 128 and the exposed polymeric material 104*b* included therein may be oriented at different angles from one another and/or they need not be parallel to one another.

The openings (and thus the exposed polymeric material on the ball striking surface) are not limited to narrow, elongated slots. Rather, if desired, all or some portion of the openings may be of a different shape, e.g., shaped and arranged to produce a stylized design, pattern, alphanumeric information, or other information on the ball striking surface, such as a logo, manufacturer name, brand name, or trademark information, etc. This feature also may be used to customize the putter head, e.g., to include a personal name or initials (such as the putter owner's name or initials), a team name, or any other desired information, or to provide an end user (such as the club purchaser or other person) with the ability to design his or her own putter face.

The overall pattern of exposed polymeric material 104*b* at the putter ball striking surface 104 (and thus the size of the openings 128) may extend and span any desired amount across the ball striking face 104 in the heel-to-toe direction, such as from 25-100% of the face's heel-to-toe direction, from 30-90% of the face's heel-to-toe direction, or even from 40-80% of the face's heel-to-toe direction. In some example structures in accordance with this invention, the overall pattern of exposed polymeric material 104*b* at the ball striking face 104 may extend across at least the central 25% of the face 104 in the heel-to-toe direction, and in some examples, the polymeric material 104*b* will extend across at least the central 40% of the ball striking face 104 or across at least the central 50% of the surface 104 in the heel-to-toe direction.

Figure 5:
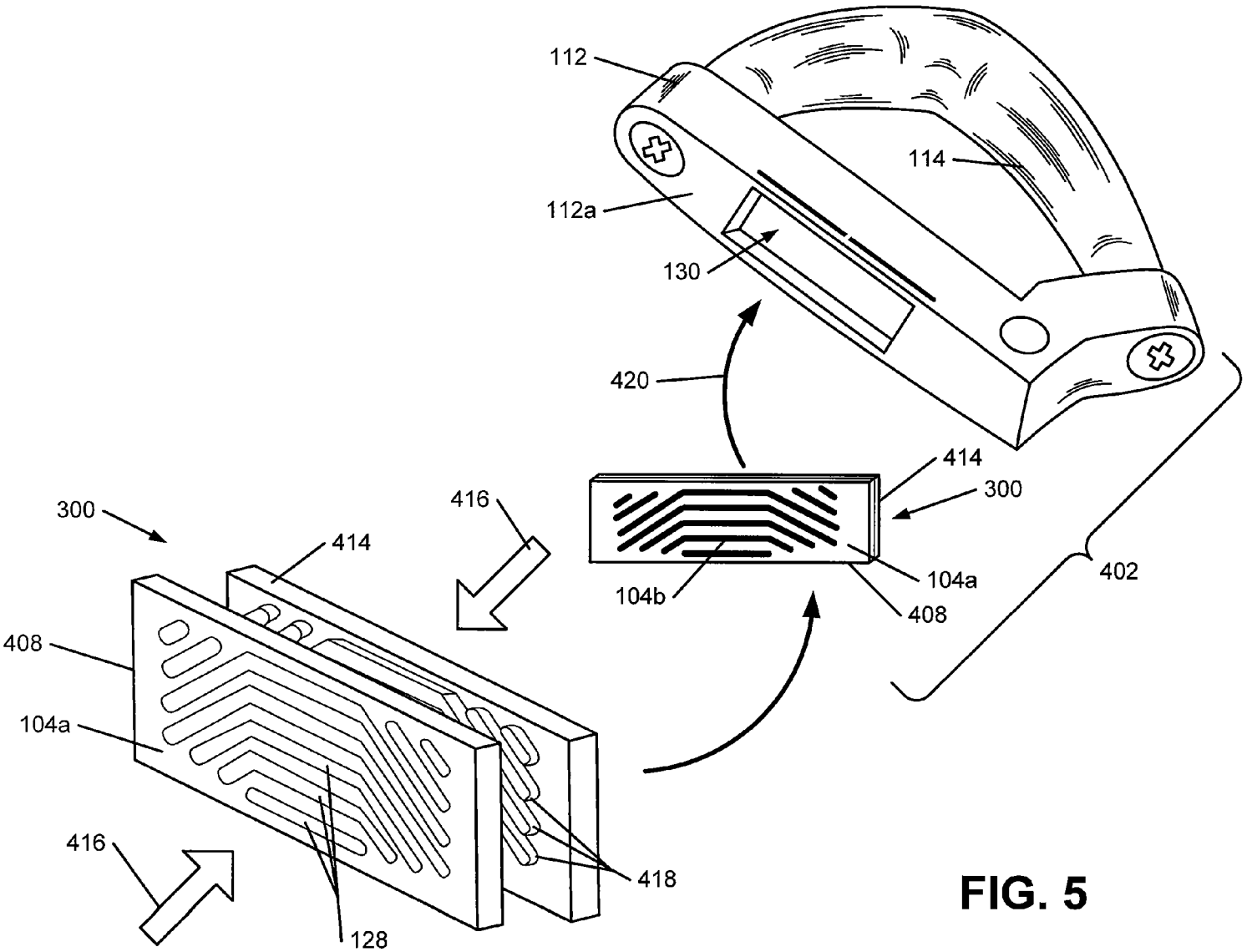

FIG. 5 illustrates an example manner in which an insert member 300 may be formed and incorporated into a putter head 402. In the arrangement of FIG. 5, the putter head 402 includes the ball striking face body member 112 and the rear member 114 engaged with it (e.g., as described above in conjunction with FIGS. 2A and 2B), and insert member 300 forms the central portion of the ball striking face 104. The putter head's ball striking face 104 in this example is made up of a front surface 112*a* of the ball striking face body member 112 and a front (exterior) surface of the insert member 300. The front surface of the insert member 300 includes the material of the ball striking face member 104*a* (e.g., a metal material, a hard polymeric material) and the exposed polymeric material 104*b* through the openings 128. The insert member 300 fits into a recess 130 provided in the front surface 112*a* of the ball striking face body member 112.

In at least some examples, the insert 300 may include a front plate portion 408, into which openings 128 of any desired sizes, configurations, shapes, etc. may be machined or otherwise formed. In some examples, the front plate 408 may be between 1 mm and 4 mm thick and, in some examples, may be approximately 2 or 3 mm thick. As mentioned, the plate 408 may include openings 128 formed therein. The openings 128 may, in some arrangements, extend completely through the plate 408 (i.e., forming one or more through holes in the plate 408), or at least some of the openings 128 may extend partially through the plate 408. Additionally or alternatively, the openings 128 may have a constant depth, width, height, etc. across the plate 408. However, in some examples, the depth, width, height, etc. of one or more openings 128 may vary along the length of the opening 128, along the plate 408, and the like. Additionally or alternatively, the openings 128, or at least some portion thereof, may be arranged generally horizontally across the central portion of the ball striking face 104 of the putter head 402 when the club is in a ball address position. In other arrangements, the openings 128 may extend in a non-horizontal linear, circular, semi-circular, or other curved pattern on the face.

The plate 408 may be formed of any suitable material, including metals such as aluminum, steel (e.g., stainless steel), titanium, nickel, beryllium, copper, combinations or alloys including these metals; polymers; and the like. Once the openings 128 are formed in the plate 408, the plate 408 may be pressed together (optionally "co-molded") with a moldable, polymer material backing 414, such as thermoplastic polyurethane or thermoset materials. In some examples, the polymer material 414 in the final putter structure (once cured) may have a hardness range between 25 and 85 Shore D. In some more specific examples, the polymer material backing 414 may have a hardness range between 35 and 45 Shore D, 50 and 60 Shore D or 60 and 70 Shore D. Forcing the polymer material 414 together with the front plate 408 (for example, as indicated by arrows 416) may be used to form the insert 300 (as shown in FIG. 5) having polymer material 414 filling the openings 128 formed in the plate 408 to provide the central portion of the ball striking face 104 with both metal and polymer at locations for contacting the ball. The surface of the polymer backing material 414 may be pre-formed with projections 418 to fit into openings 128, and/or the polymer material 414 may be soft and pliable enough to be forced into the openings 410 during the pressing operation (and optionally later hardened or cured). If necessary or desired, the plate 408 and polymer material 414 may be held together using an adhesive or cement (e.g., double sided tape), mechanical connectors, etc. This combination of metal and polymer materials on the ball striking face 104 may provide improved performance of the putter including softer feel, increased spin rate, truer roll, a more metallic ball striking sound, etc.

In some examples, during the pressing or co-molding process, the front surface of the plate 408 (which will correspond to a portion of the ball striking face 104 of the putter head 402) may be held against a mold surface so that grooves (e.g., grooves 210) may be formed in the polymer material (e.g., as described above in conjunction with FIG. 3D). Optionally, if desired, some portion of the grooves 210 may be cut into the metal portion 104*a* at the location of the openings 128 either before or after the co-molding or pressing process (or other engagement of the plate 408 with the polymer material 414). Alternatively, if desired, the grooves 210 may be cut into the polymer material 414 and/or the metal of the plate 408 after the insert 300 has been made.

As noted above, the ball striking face body member 112 may include a recess 130 formed in the front face 112*a* thereof, and this recess 130 may be formed in any desired manner. For instance, the recess 130 may be milled or otherwise machined into the front face 112*a* during manufacture, or the front face 112*a* may simply be formed into the desired shape, e.g., formed during a molding, casting, forging, or other fabrication operation to include the recess 130. The insert 300 may be shaped to correspond to the shape of the recess 130 and may be configured to be received in the recess 130 (e.g., as shown by arrow 420). The insert 300 may be engaged with or connected to the recess 130 and/or the ball striking face body member 112 in any desired manner, such as via adhesives and cements (e.g., double sided adhesive tape); via fusing techniques (e.g., welding, soldering, brazing, etc.); via mechanical fasteners or connectors (including releasable mechanical connectors); and the like. If desired, the insert 300 may rest on or press against a ledge or other structure defined in the recess 130 (e.g., along the side, top, and/or bottom edges of the recess 130).

In some examples, the insert 300 may be removable to allow for replacement, customization, and/or personalization of the insert 300 and/or putter head 402. For instance, the insert 300 may be releasably connected to the ball striking face body member 112 using mechanical connectors to secure the insert 300 in the recess 130 (e.g., screws, bolts or other connectors may extend from a rear side of the putter head toward a front region of the putter head to engage threaded regions provided on the insert 300, it may be engaged from the bottom surface of the putter head upward, it may be engaged from the top surface of the putter head downward, etc.). Personalization and customization features may include various characteristics such as polymer and/or metal color (e.g., team colors, color associated with a cause or promotion, player preference, etc.); polymer and/or metal hardness (e.g., harder or softer for different play conditions or swing types); graphics on the polymer and/or metal (e.g., logos, etc.); alphanumeric or textual information; etc.

In some arrangements, the metal plate 408 may be replaced (or at least partially replaced) by a plate formed of a polymer of a different hardness from the backing material polymer 414, thereby forming an insert 300 of all polymer. For instance, the metal plate 408 may be replaced with a plate formed of a polymer material having a higher Shore D hardness value than the Shore D hardness of the polymer 414 filling the openings 128 of the insert 300. This "all polymer" insert may aid in further reducing weight associated with the putter head 402. Additionally or alternatively, the polymer material 414 may be replaced with a metal of a different hardness from the metal plate 408, thereby forming an insert 300 of all metal materials.

If desired, the major interior surface defining the recess 130 may be formed to include a polymer or other material, to provide a consistent backing or base against which insert 300 is mounted. As another alternative, if desired, the material of the polymer backing layer 414 may be included in the recess 130 and the putter head 402 may be formed by pressing plate 408 against the polymer backing material 414 in the recess 130 to force the polymer material 414 into the openings 128 of the plate 408. If necessary, one or more overflow holes may be provided to allow any excess polymer material 414 to escape from the putter head 402 during the pressing operation. As yet another alternative, if desired, the adhesive used to hold the insert 300 in the recess 130 may have a foam or other cushioning layer for use as this consistent backing or base (e.g., foam backed adhesive tape).

In some examples, the polymer included in the recess 130 (if any, e.g., as a backing or base) may be a material different from the polymer material 414 filling the openings 128 of the insert 300. For instance, polymers of different Shore hardness values may be used for the polymer in the recess 130 and the polymer 414 filling the openings 128. In some examples, the polymer 414 filling the openings 128 may have a higher Shore D hardness than the polymer in the recess 130. The harder polymer 414 in the openings 128 may aid in creating top spin on the ball while the softer polymer in the recess may aid in providing a soft or consistent "feel" for the putter head 402 (e.g., by damping vibrations).

Alternatively, if desired, an insert structure similar to that of FIGS. 1A, 1C, and 5 could be provided but with the front plate portion 408 formed of a polymer material and with metal material (or a different polymer material, of different hardness) filling the grooves 128. The multi-material face (e.g., polymer and metal at the ball striking face) may be provided, for example, in any of the various methods and using any of the structures described in the patent and patent applications mentioned in the "Related Application" section above.

FIGS. 6A through 6C illustrate additional insert arrangements for a putter's ball striking face that may be used according to some example aspects of the invention. In these example arrangements, the insert 506 may be formed of plastic (polymer, e.g., thermoplastic polyurethane, thermoset polyurethanes or other polymers, etc.), and it may include recesses 510 formed therein. The recesses 510 may be cut or machined into the face of the insert 506 or they may be formed in the insert 506 when it is made (e.g., during molding). However, as shown in FIGS. 6B and 6C, the recesses 510 may not extend completely through the insert 506 in these example structures. Rather, the recesses 510 may be formed in the polymeric surface 508 of the insert 506.

In some examples, an edge element 512, such as a thin metal bar, strip or other metal layer, is formed or laid within the recesses 510. FIG. 6B is a cross section of one example insert 506 taken along line 6B-6B of FIG. 6A illustrating this recess 510 and edge element 512 arrangement. The metal bars or strips 512 may be formed of any suitable metal, including aluminum, titanium, steel, nickel, beryllium, copper, combinations or alloys including these metals, etc. In some examples, the thin metal bars 512 may be positioned in a center of the recess 510 formed in the polymer insert 506, although they also may be positioned to one side (top or bottom) of the recess 510, if desired. The metal strips 512 and recesses 510 formed in the insert 506 may include edges, e.g., sharp edges, that may function as, or similarly to, edges of grooves 210 provided in other arrangements described above. The metal strips 512 may be dimensioned and arranged so that their base exterior surfaces are flush or substantially flush with the main exterior surface 508 of the insert 506. While FIG. 6B shows an insert 506 with "C-shaped" recesses 510 (in cross section), this is not a requirement. Other cross sectional shapes are possible without departing from this invention, such as the box-shaped recesses 510 shown in FIG. 6C. V-shaped recesses, non-symmetrical recesses, or any other desired recess shape may be provided without departing from this invention. Also, if desired, a single insert 506 may have recesses 510 of different cross sectional shapes.

The metal strips 512 may be provided within the recesses 510 and/or connected to the polymer insert 506 in any desired manner. For instance, the metal 512 may be engaged with the insert 506 via adhesives or cements, mechanical connectors, deposition techniques, etc. Multiple metal strips 512 also may be interconnected with one another and mounted on a rear surface of the main base portion of the insert 506 such that the front of the strips 512 extend to and project through openings in the insert 506 and are exposed at the front surface 508.

Insert 506 may be engaged with the main putter body portion (e.g., ball striking face body member 112) (as indicated by arrow 514) using various engagement or connection techniques as described above. For instance, the insert 506 may be connected to the recess 130 and/or other portion of the ball striking face body member 112 via adhesives (e.g., double sided adhesive tape), fusing techniques, mechanical connectors, and the like.

Optionally, if desired, a rear or back side of the insert 506 may include a similar groove and metal strip structure, thus forming a two-sided, reversible insert. The rear or back side insert arrangement may optionally include a different groove pattern or configuration, different metal type, different polymer type, different hardnesses, etc. in order to provide different sound, feel, hardnesses, etc. The various other insert structures described above (e.g., insert member 300) also may have reversible characteristics.

In still other arrangements, the metal and polymer may be reversed to provide an insert 506 having an opposite arrangement from that shown in FIGS. 6A and 6B. For instance, the main base portion of the insert 506 may be formed of a metal (e.g., aluminum, titanium, steel, nickel, beryllium, copper, combinations or alloys including these metals, etc.) and may have a plurality of recesses 510 formed in a surface thereof. Strips of polymer 512 may then be positioned within the recesses 510, such as in a center of the recesses 510. The edges of the metal recesses 510 and the edges of the polymer strips 512 may then act as grooves or scorelines 210, similar to other arrangements described herein.

Figure 7B:
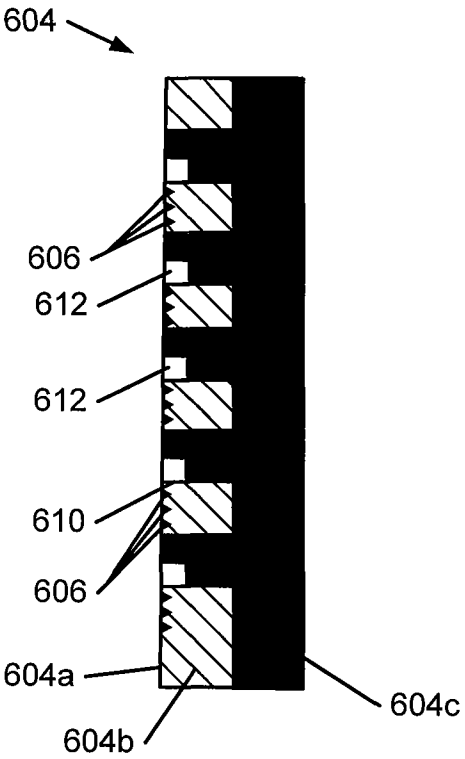
Figure 7A:
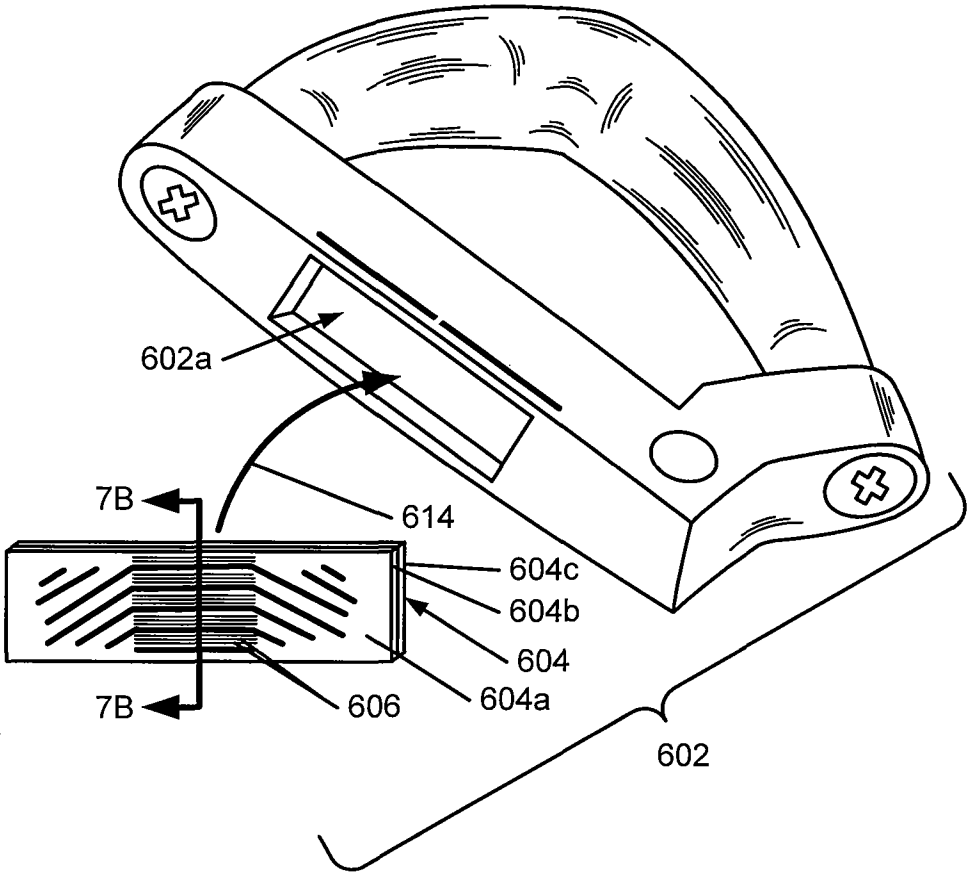

FIGS. 7A and 7B illustrate additional example features that may be included in any of the putter head structures described herein. FIG. 7A illustrates an example putter head 602 having an insert 604, e.g., according to any of the above described arrangements. In this illustrated example arrangement, the ball striking face 604*a* of the insert 604 includes a plurality of microgrooves 606 formed between the polymer filled openings 610. In some examples, the microgrooves 606 may be about 1 micron to 1 mm wide and/or deep. The microgrooves 606 may be cut into the metal or polymer base material of the insert 604 in any desired manner, such as by using a laser. Any number of microgrooves 606 may be cut into the metal or polymer base material, and the microgrooves 606 may have any desired curvature, cross section, shape, relative arrangement, pattern, or orientation, etc. Further, the microgrooves 606 may be cut into the area between some or all adjacent sets of the larger openings 610 or, alternatively, the microgrooves 606 may be cut in any other desired areas, including over the entirety of the ball striking face.

FIG. 7B is an enlarged cross section of the insert 604 taken along line 7B-7B in FIG. 7A. The insert 604 of this illustrated example includes a ball striking face member 604*b* (e.g., made from metal) and a backing portion 604*c* that may be a polymer, such as thermoplastic polyurethane or thermoset materials, or a metal, such as aluminum, titanium, steel, nickel, beryllium, copper, combinations or alloys including these metals, etc. Similar to some arrangements described above, the ball striking face 604*a* includes a plurality of grooves 612 cut into it (e.g., into the ball striking face member 604*b*, into the backing portion 604*c*, or partially into both portions 604*b* and 604*c*). The plurality of microgrooves 606 cut into the ball striking face 604*a* between the larger groove areas 612 also is shown in FIG. 7B. As mentioned above, any number of microgrooves 606 may be cut into the insert 604 within the areas provided between the adjacent larger groove areas 612 (e.g., 2, 3, 4, 5, or more microgrooves 606).

The insert 604 may be engaged with the putter head 602 (as indicated by arrow 614) using any of the techniques and/or methods described above. For instance, the insert 604 may engaged with the club head 602 at recess 602*a* using adhesives (e.g., double sided adhesive tape), fusing techniques, mechanical connectors, etc. Also, microgrooves 606 of the types described above also may be used in conjunction with any of the arrangements and ball striking faces described herein. While shown as parallel lines, the microgrooves 606 may have other shapes or arrangements, such as criss-cross or X-shapes, etc.

Figure 8:
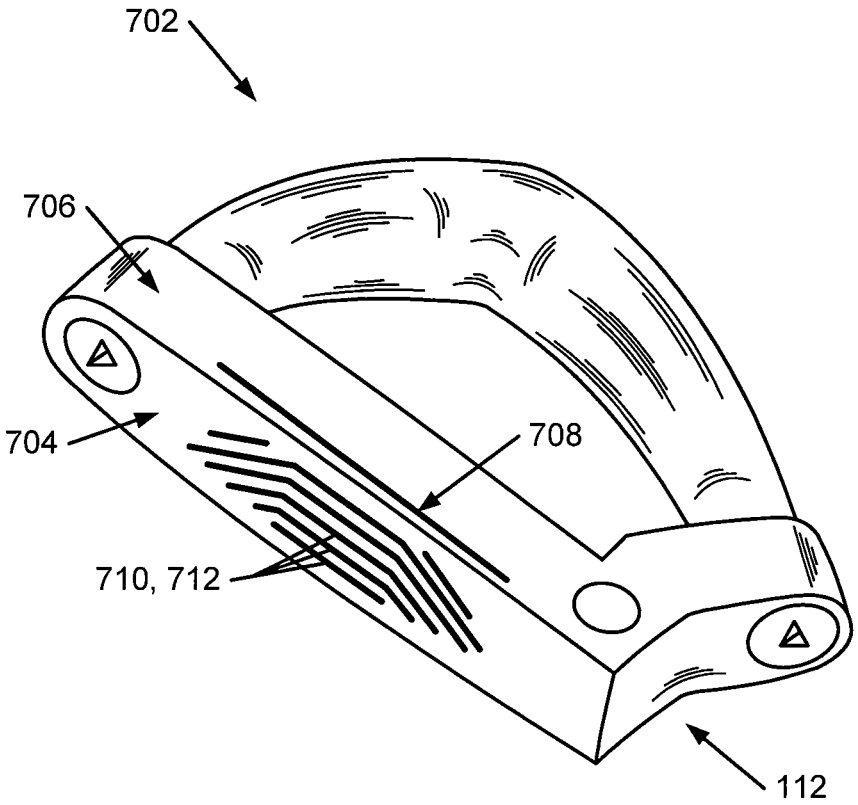

FIG. 8 illustrates another example putter head structure 702 in accordance with this invention. In this example structure, at least the ball striking face body member 112 of the putter head 702 is comprised of a single piece of material. The ball striking face body member 112 has a recess machined into it so that a recess is formed behind the ball striking surface 704. This recess may be machined into the ball striking face body member 112 so as to leave an opening 708 at an exterior of the ball striking face body member 112, e.g., at the top surface 706 in this example structure 702 (although the opening 708 may be provided at any one or more of the bottom, rear, or side surfaces as well). Openings 710 also may be machined into the front of the ball striking face 704, and these openings 710 may extend to and open into the recess inside the ball striking face body member 112. The recess may be filled with polymeric material 712 such that the polymeric material 712 is exposed through the top (or other) opening 708 and through the ball striking face openings 710 (if desired, this exposed polymeric material 712 at the top opening 708 may be colored and shaped so as to function as an alignment aid for the putter head). Once cured and in the final product, the polymeric material 712 may be softer than the material (e.g., metal) of the exterior surface of the ball striking face 704 in the areas adjacent and between the openings 710. The ball striking face 704, including the internal recess and openings 710, may be made in the manner described, for example, in the patent and patent applications mentioned in the "Related Application" section above, and the ball striking face 704, internal recess, and openings 710 may have any of the various features and characteristics described in these "Related Applications." In this manner, the central portion of the ball striking face 704 includes exposed polymeric material 712 in openings 710 and the intermediate metal material between the openings 710.

Also, the ball striking surface 704 may include grooves defined in the material of the ball striking face portion 704*a* and/or the polymeric material 710, e.g., in any of the manners described above in conjunction with FIGS. 3B through 3F.

Figure 9:
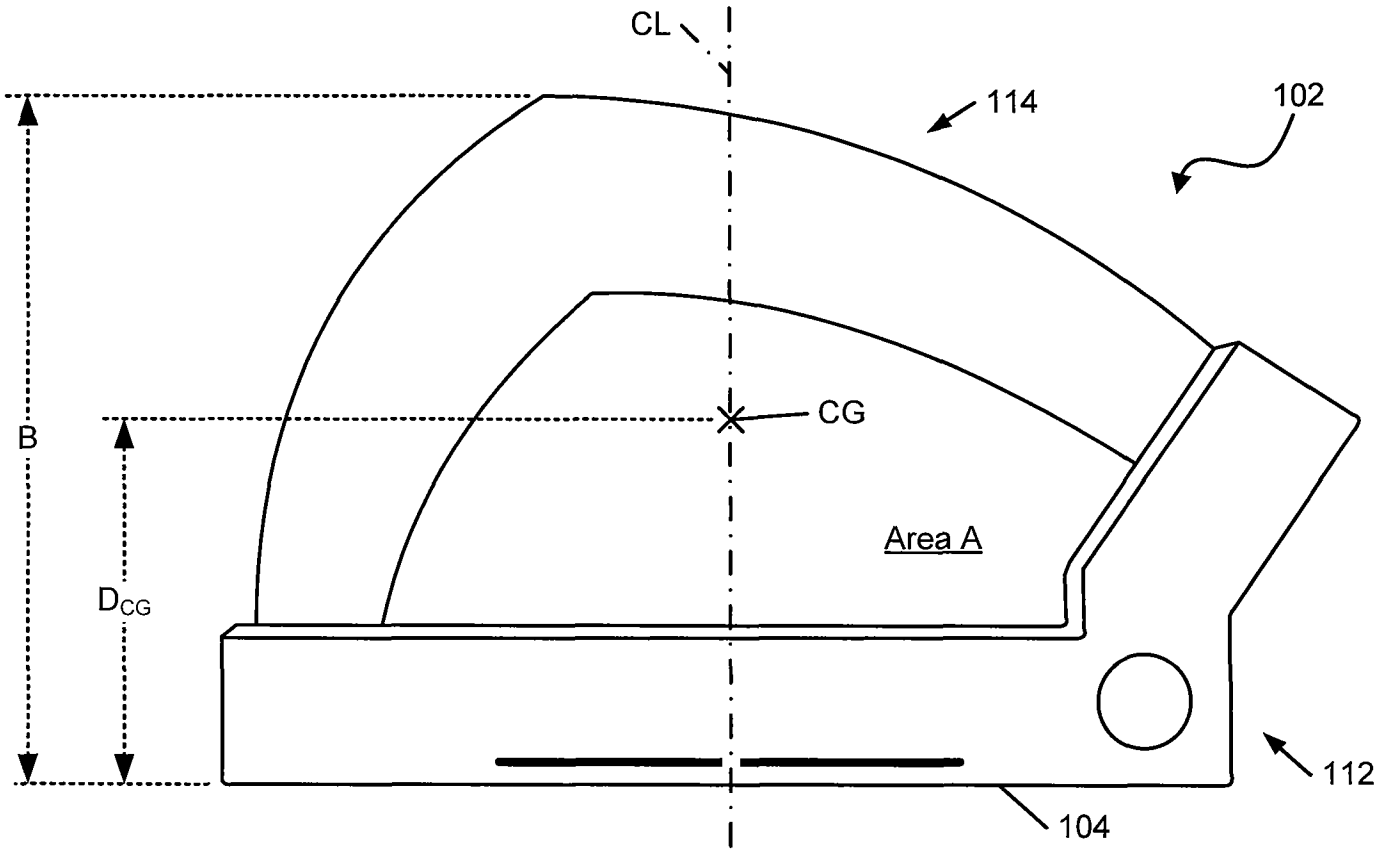

FIG. 9 illustrates additional features that may be provided in putter head constructions in accordance with at least some examples of this invention. FIG. 9 illustrates an example putter head 102, e.g., like those shown and described above in conjunction with FIG. 1A through 8. In at least some example putter head constructions in accordance with this aspect of the invention, the putter head will have a deeper center of gravity location in the Y-direction or breadth direction (i.e., in a direction from the ball striking face 104 to the rear of the putter head 102 in FIG. 9). In manners that are known in the art, the center of gravity ("CG") of a golf club head 102 can be located in the club head's X (heel-to-toe), Y (front-to-back) and Z (top-to-bottom) axis directions. In putter heads 102 in accordance with at least some examples of this invention, a ratio of: (a) the depth of the location of the putter head center of gravity from the frontmost location of the ball striking face 104 (dimension $D_{CG}$ in FIG. 9) to (b) the overall club head breadth dimension B from front-to-back will be at least 0.425, and in some examples, at least 0.45, at least 0.48, at least 0.5, at least 0.51, and even at least 0.52. In some examples of this aspect of the invention, the putter heads will have an overall front-to-rear dimension of at least 2 inches, and in some examples at least 2.25 inches, or even at least 2.5 inches. Putter heads in accordance with at least some examples of this invention also may have an overall front-to-rear dimension B of less than 3.5 inches, and in some examples, less than 3.25 inches or even less than 3 inches. These measurements are made in a manner consistent with the manner such measurements are made to confirm compliance with U.S.G.A. rules and regulations. As some additional examples, putter head structures in accordance with at least some examples of this aspect of the invention will define an enclosed open area (e.g., area A defined between a rear of the ball striking face member 112 and the rear body member 114).

The following table compares the $D_{CG}/B$ ratio of putter heads in accordance with some examples of this invention against various other commercially available putter heads.

TABLE

| Putter | Depth of Center of Gravity "$D_{CG}$" (in.) | Overall Putter Breadth "B" (in.) | $D_{CG}/B$ |
|---|---|---|---|
| Invention Sample of FIG. 1A with a Steel Back | 1.508 | 2.790 | 0.541 |
| Invention Sample of FIG. 1A with a Rubberized Tungsten Back | 1.445 | 2.745 | 0.526 |
| Ping JAS Craz E Moment | 1.352 | 3.702 | 0.365 |
| Odyssey White Ice 2 Ball | 1.307 | 3.481 | 0.375 |
| TaylorMade Rossa Monza Spider | 1.480 | 3.771 | 0.392 |
| NIKE Method 001 | 0.461 | 1.124 | 0.410 |

As is evident from this Table, the putter structures in accordance with the examples of this invention have a higher $D_{CG}/B$ ratio than other commercially available putters (which corresponds to a deeper center of gravity location in the front-to-rear direction). The location of the center of gravity (and thus, $D_{CG}$) can be controlled in putter head structures in accordance with examples of this invention, at least in part, by selection of the various materials for use in the putter construction (e.g., by selecting lighter or less dense materials for the face member 112 (e.g., aluminum, carbon or other fiber reinforced polymers, other lightweight metals or polymers, etc.) and heavier or more dense materials for the rear body member 114 (e.g., heavier metals, like steel, lead, tungsten, etc.; polymers or other materials doped with weighted materials, such as lead or tungsten; etc.). If desired, separate weight members also may be provided on the rear body member 114 to help move the center of gravity rearward.

Figure 10:
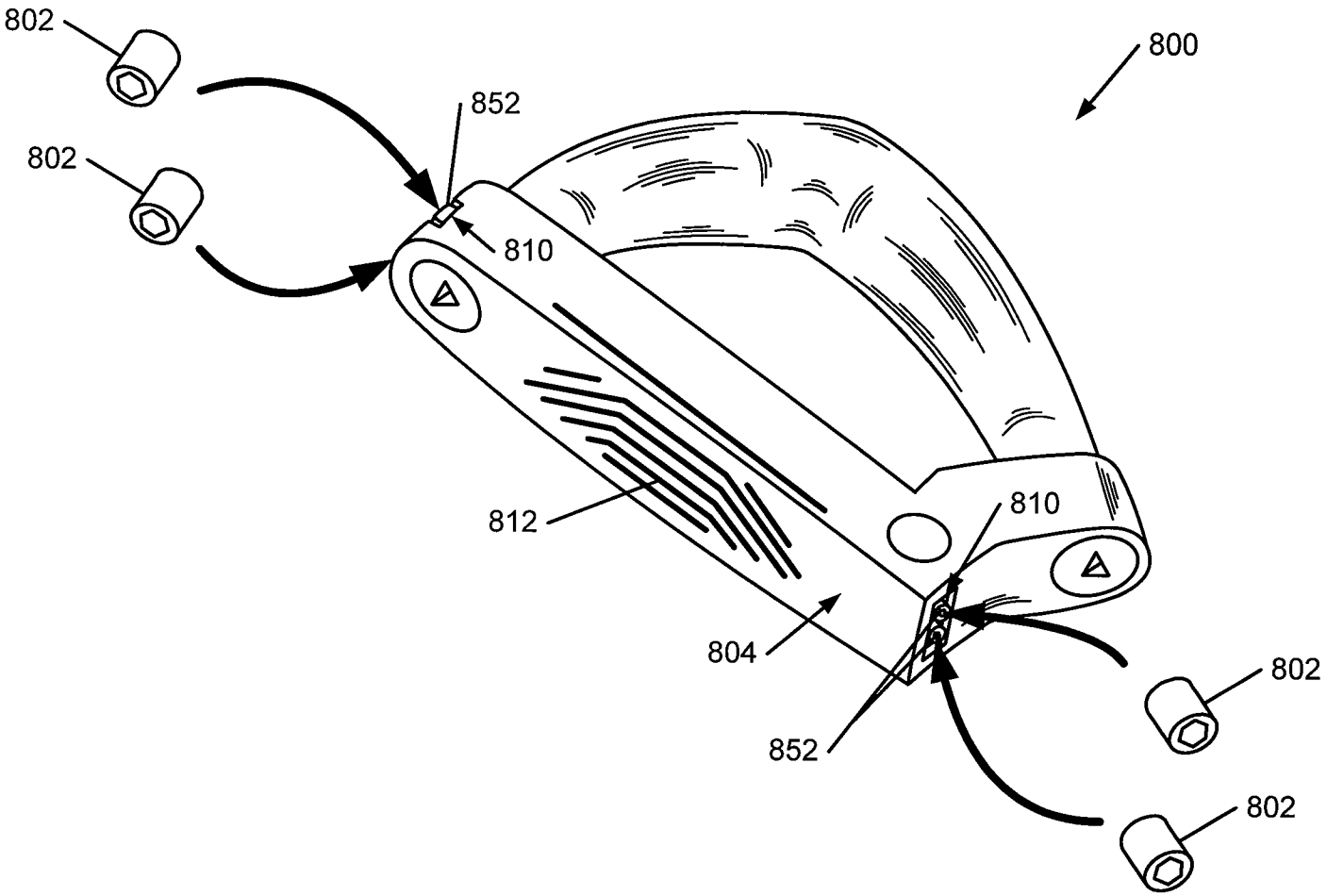

FIG. 10 shows another example putter head structure 800 in accordance with at least some examples of this invention. In this illustrated example structure, the putter head 800 includes weights 802 mounted in the heel and/or toe side edges of the ball striking face 804 (and close to the ball striking face 804). As shown in this figure, each of the side edges of the ball striking face 804 may include ports 852 in which weights 802 may be mounted. Optionally, if desired, the weights 802 may be mounted in the ports 852 in a removable manner, via any desired type of releasable connection, including, for example, mechanical connectors (e.g., threaded connections, turnbuckle type connections, spring-loaded connections, etc.). Also, while two vertically spaced weights 802 are shown on each side edge of the putter ball striking face 804 in FIG. 10, any desired number and/or orientation of weights, weight ports, and the like may be provided without departing from this invention. If desired, each port 852 need not contain a weight 802 (and indeed, if desired, no port 852 needs to contain a weight 802) when the putter head 800 is used for play. Also, if desired, the weights 802 and/or weight ports 852 may be fully contained within 1.5 inches of the very front of the putter's ball striking face 804 (in the front-to-rear breadth direction), and in some examples, the weights 802 and/or weight ports 852 will be fully contained within 1 inch or less or even 0.75 inches or less from the front of the ball striking face 804.

As further shown in this figure, if desired, the weights 802 and the ports 852 therefore may be recessed or at least partially countersunk into the putter head structure 800, optionally, so that the weights 802 are not visible to the player when the putter head 800 is being used. This is shown in FIG. 10 by the countersink holes 810. While a single countersink hole 810 on each side edge of the ball striking face 804 is shown in FIG. 10, any number of countersink holes 810 may be provided without departing from this invention (e.g., one countersink hole 810 per side containing all weight ports 852 on that side, one countersink hole 810 per weight port 852, and any combination between these extremes).

If desired, in at least some example structures in accordance with this aspect of the invention, during manufacture of the putter heads 800, one or both countersink hole(s) 810 may form a portion of the machined in recess formed behind the ball striking face portion, e.g., like the machined in recess described in the example putter head structure described with respect to FIG. 8 and/or those described in U.S. Pat. No. 7,717,801, U.S. Pat. No. 7,806,779, and the other "Related Applications" noted above. Then, the polymeric material 812 that is ultimately exposed through and forms a portion of the ball striking face 804 may be injected into the putter head through this machined in recess. A cap or other structure may be provided (if necessary) to close in the polymeric material and at least partially close off the recess, and this cap or other structure can provide the structure for the weight port(s) 852 to which the weight(s) 802 are mounted. As another alternative, if desired, the weights 802 may be mounted on an exposed surface of the polymeric material in the recess without the need for a separate weight port 852.

Weights 802 and their location close to the ball striking surface 804 as described above in conjunction with FIG. 10 may provide various advantageous features. For example, by placing additional weight out toward the sides of the putter head body, the putter head's moment of inertia about the z-axis (vertical axis) may be increased, thereby increasing the putter head's resistance to twisting on off-center hits.

Additionally, these features of the invention can help customize or personalize the putter head to help users make better contact with the ball and launch the ball in the desired direction. More specifically, the amount of weight provided in the heel and toe weight ports 852 can affect the putter head's motion during a putting stroke. As some more concrete examples, for players that tend to hit the ball with an open putter face, more weight can be provided in the putter heel port(s) 852 to help the putter face close a bit earlier in the putting stroke. Alternatively, for players that tend to hit the ball with a closed putter face, more weight can be provided in the putter toe port(s) 852 to help the putter face remain open a bit longer in the putting stroke. Adjusting the weighting in the vertical direction can also help fine tune and control the location and/or height of the bottom of the arc of the putting stroke. Club fitters can use these weights 802 and weight ports 852 to help better match a putter head to the user's stroke to provide more consistent and straight putting.

Heel and/or toe oriented weights, optionally as part of or very close to the ball striking portion of the putter head (just back from the ball striking face) as shown in FIG. 10 and described above, may be used in any desired putter head constructions without departing from this invention, including the various constructions described above in conjunction with FIGS. 1A through 9, as well as in the putter head constructions described in U.S. Pat. No. 7,717,801; U.S. Pat. No. 7,806,779; U.S. patent application Ser. No. 12/612,236; and U.S. patent application Ser. No. 12/755,330 and/or the constructions described below in conjunction with FIGS. 11 through 18B.

Figure 11:
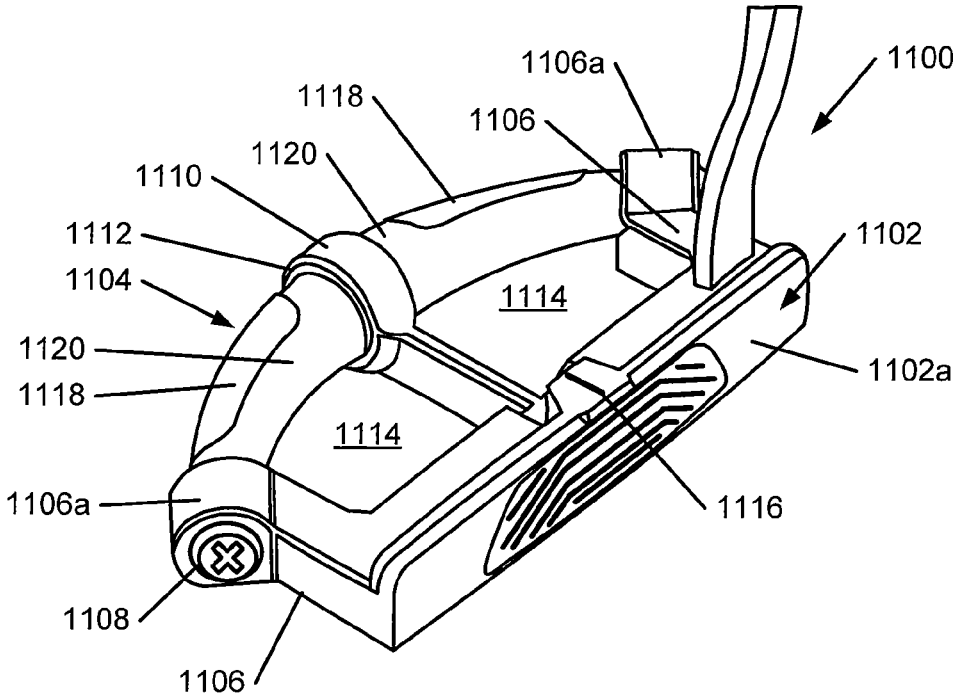

FIG. 11 illustrates another example putter construction 1100 in accordance with some examples of this invention. Like the putters described above, this example putter 1100 includes a ball striking face body member 1102 and a rear body member 1104 that is optionally removably attached to the ball striking face body member 1102. This example ball striking face body member 1102 includes a rearward extending arm 1106 located at each end of the ball striking face 1102*a* (one arm 1106 at the heel end and one arm 1106 at the toe end of the ball striking face 1102*a*). The rearward extending arms 1106 extend generally perpendicularly rearward from the edges of the ball striking face 1102*a* and then include outwardly angled free ends 1106*a* in this example structure. The free ends 1106*a* of each arm 1106 include structure for engaging the rear body member 1104, such as screw elements 1108 (or other releasable engaging systems, as described above), and for mounting the rear body member 1104 to the ball striking face body member 1102. The rear body member 1104 of this example structure is a continuously arched member that extends from the free end 1106*a* of one arm 1106 to the free end 1106*a* of the other arm 1106. Notably, the abutting faces of the ball striking face body member 1102 and the rear body member 1104 are angled with respect to the ball striking surface 1102*a*. While any desired angle(s) may be used without departing from the invention, these angles (which may be the same or different at the toe end and the heel end for a given putter head) will typically be within the range of 20 to 70°, and in some examples, within the range of 30 to 60° (an angle of about 45° is shown in FIG. 11).

FIG. 11 further shows that a rearward extending body support member 1110 extends rearward from a central rear portion of the ball striking face body member 1102 (open spaces or through-holes 1114 are defined on each side of the body support member 1110). The rearward extending body support member 1110 may be integrally formed as part of the ball striking face body member 1102 or it may be a separate part that is engaged with the ball striking face body member 1102 (e.g., by cements or adhesives, by mechanical connectors, by fusing techniques, etc.). The body support member 1110 of this illustrated example includes a central opening 1112 into which the main body portion of the rear body member 1104 is received (e.g., by a sliding action). Optionally, if desired, a central portion of the rear body member 1104 may be somewhat enlarged or otherwise include appropriate structures for securely engaging and fitting within the opening 1112. Due to its central positioning and its longitudinal length extending in the ball target launch direction, the body support member 1110 also may function as an alignment aid for the putter 1100. Another alignment aid element 1116 is provided at the top surface of the ball striking face body member 1102 in this illustrated example.

Alternatively, if desired, the rearward extending body support member 1110 may be integrally formed as part of the rear body member 1104, and it may extend forward to and attach to the ball striking face body member 1102 (e.g., by cements or adhesives, by mechanical connectors, by fusing techniques, etc.). As yet another alternative, if desired, the rearward extending body support member 1110 may be a separate part (or multiple parts) that is (are) engaged with both the ball striking face body member 1102 and the rear body member 1104.

The various parts of the putter 1100 may be made from any desired materials without departing from this invention, including the various materials described above. As some more specific examples, if desired, the ball striking face body member 1102 may be made from aluminum, titanium, aluminum containing alloys, titanium containing alloys, stainless steels, polymeric materials, fiber reinforced materials, or the like. The rear body member 1104 may be made from any desired materials as well, including, for example: steel, stainless steel, rubberized tungsten material, lead or tungsten doped materials, etc. In the illustrated example, the rear body member 1104 includes stainless steel portions 1118 and rubberized tungsten portions 1120 (e.g., wrapped around the stainless steel portions 1118).

The screw elements 1108 may be made from a heavy or dense material, so as to provide desired weighting characteristics for the putter 1100. For example, the screw elements 1108 may include lead, tungsten, or other dense or heavy material so as to increase weighting at the rear, extreme outside edges of the putter head. This feature increases the putter head's moment of inertia (i.e., resistance to twisting) about a vertical z axis (e.g., a vertical axis optionally running through the putter head's center of gravity, through the center of the ball striking face 1102*a*, or through some other desired location), particularly when a ball is struck somewhat off-center of the club face 1102*a*.

Figure 12:
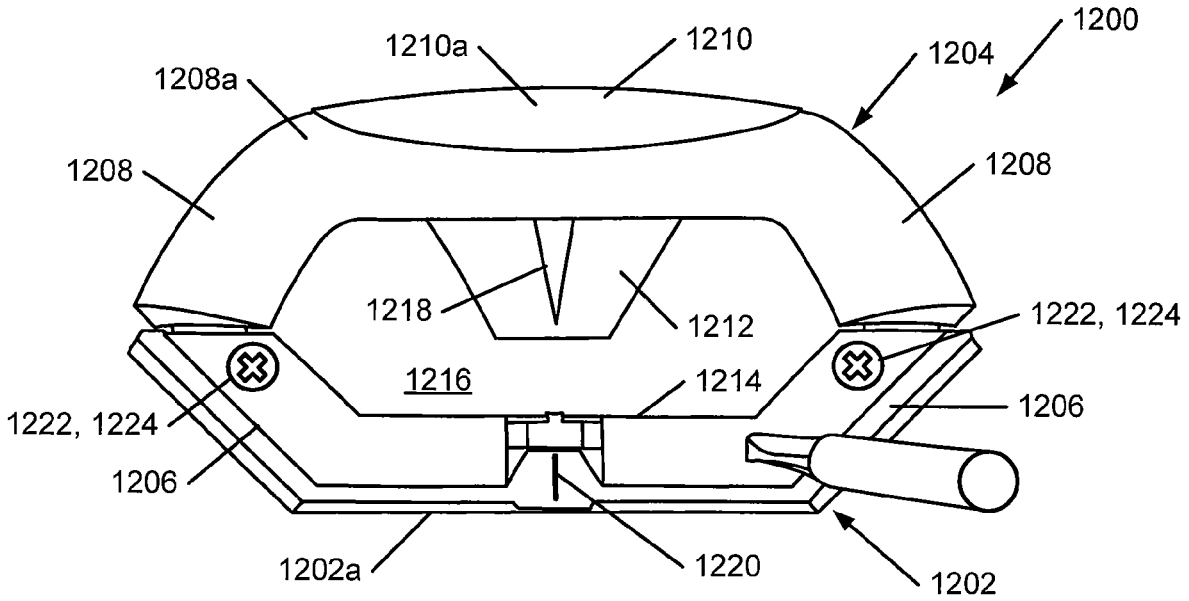

FIG. 12 illustrates another example putter construction 1200 in accordance with at least some examples of this invention. The ball striking face body member 1202 of this example structure 1200 is similar to that described above in conjunction with FIG. 11, with each end of the ball striking face 1202*a* including a rearward extending arm 1206. In this example structure 1200, however, the rearward extending arms 1206 extend back from the edges of the ball striking face 1202*a* in an outwardly extending angular manner.

The rear body member 1204 of this example structure 1200 is mounted at the free ends of the rearward extending arms 1206 (optionally in a releasable manner). Notably, in this structure 1200, the abutting surfaces of the ball striking face body member 1202 and the rear body member 1204 are substantially parallel to the ball striking face 1202*a*. This example rear body member 1204 includes two generally angled arms 1208 leading to the free ends, and a middle body portion 1210 between the arms 1208. The middle body portion 1210 is the rearmost part of this putter construction 1200, and it generally runs substantially parallel to the ball striking face 1202*a*, although it may be angled, rounded, curved, or the like without departing from this invention.

The inside portion of the rear body member 1204 of this example structure 1200 includes an inwardly or forwardly extending platform or surface 1212 that extends a portion of the way between the middle body portion 1210 and the back side 1214 of the ball striking face body member 1202. The inwardly extending platform or surface 1212 could extend any desired extent of the distance between the middle body portion 1210 and the back side 1214 without departing from this invention, including connecting to the ball striking face body member 1202, if desired. As shown, a single, continuous, open space 1216 is defined between the rear body member 1204 and the ball striking face body member 1202 in this illustrated example structure 1200.

Notably, in this illustrated example, the inwardly extending platform or surface 1212 includes an alignment aid 1218 formed thereon. This triangular alignment aid 1218 functions in cooperation with the alignment aid 1220 provided on the top surface of the ball striking face body member 1202. Any desired type(s) of alignment aids 1218 and/or 1220 may be provided without departing from this invention.

The structure 1200 of FIG. 12 further includes weight ports 1222 with weights 1224 mounted therein. In this illustrated example, the weight ports 1222 are located near the free ends of the arms 1206. This arrangement also helps maintain a high moment of inertia about vertical axes for the putter 1200, by concentrating some weight rearward and away from the club head's center of gravity and center line. Additionally or alternatively, if desired, weight ports and weights may be provided at other locations on the putter 1200 without departing from this invention, including on the rear body member 1204, on the underside of arms 1206, etc.

The various parts of the putter 1200 of FIG. 12 may be made from any desired materials without departing from this invention, including the same materials described above for similar parts shown in FIG. 11. As an example, the rear body member 1204 may include a stainless steel portion 1210*a* with a rubberized tungsten portion 1208*a*, e.g., wrapped around the stainless steel portion 1210*a*.

Figure 13:
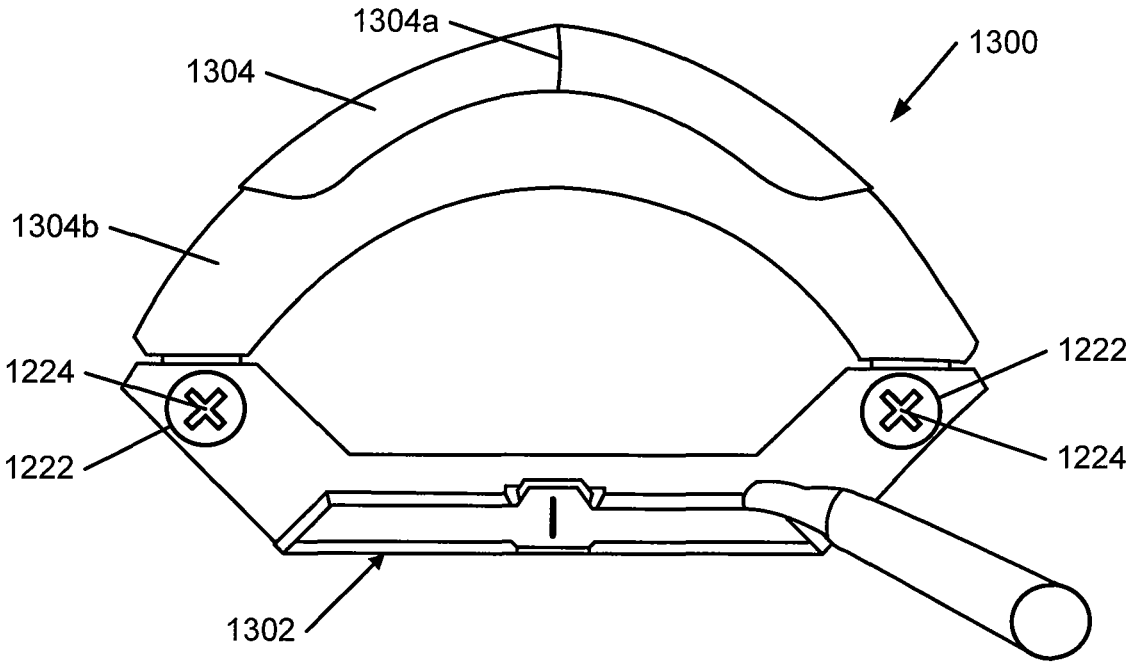
Figure 14:
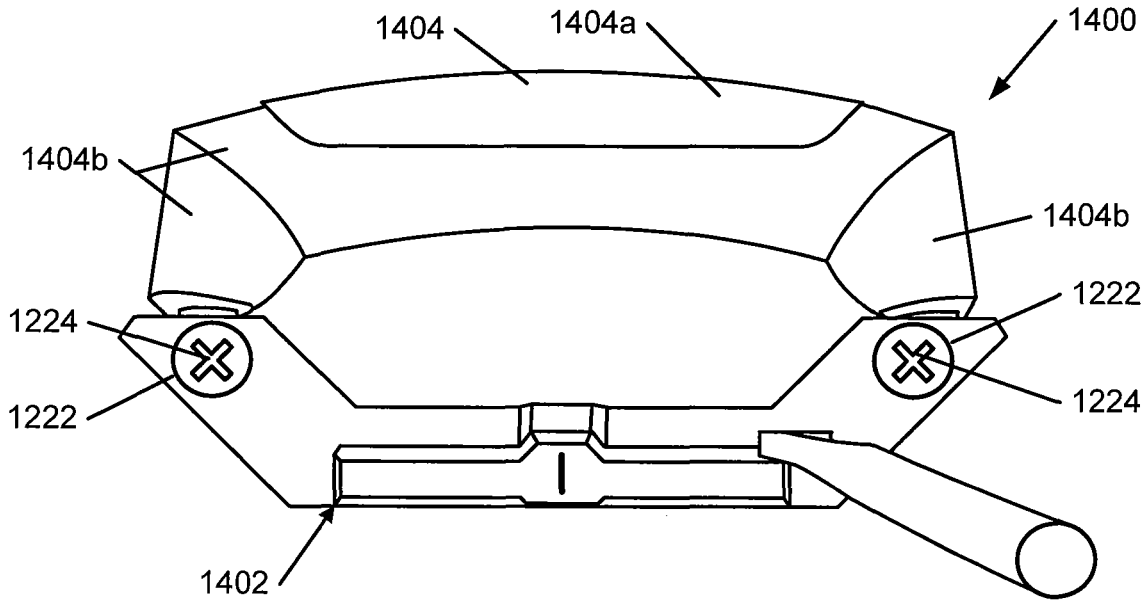

FIGS. 13 and 14 show additional examples of putters 1300 and 1400, respectively, that are similar to the putter 1200 of FIG. 12, but have somewhat different sizes, shapes, and features. Notably, these example structures include the weight ports 1222 and weights 1224, similar to those shown in FIG. 12, on the free ends of the rearwardly extending arms of the ball striking face body members 1302 and 1402. If desired, the weights 1224 may be removable from the weight ports 1222 to enable a user or club fitters to change the weighting characteristics of the club head, e.g., for customization or user preference matching purposes. The rear body members 1304 and 1404 may include stainless steel portions 1304*a*, 1404*a* and rubberized tungsten portions 1304*b*, 1404*b*, e.g., in manners similar to FIGS. 11 and 12 above.

FIGS. 13 and 14 also highlight potential interchangeability features of putter constructions in accordance with at least some examples of this invention. For example, the more bowed rear body member 1304 of FIG. 13 also could be used on the ball striking face body member 1402 of FIG. 14 and/or the more square rear body member 1404 of FIG. 14 could be used on the ball striking face body member 1302 of FIG. 13. Any of the various parts may be interchangeable to enable a player or club fitter to select appropriate parts to better suit one's needs and one's preferences. If desired, an assortment of parts could be sold or otherwise provided in a kit to enable players to make changes as they desire, e.g., based on course conditions, personal preferences, green speeds, right eye/left eye dominance, etc.

The various parts of the putters 1300 and 1400 of FIGS. 13 and 14, respectively, may be made from any desired materials without departing from this invention, including the same materials described above for similar parts shown in FIG. 11.

Figure 15A:
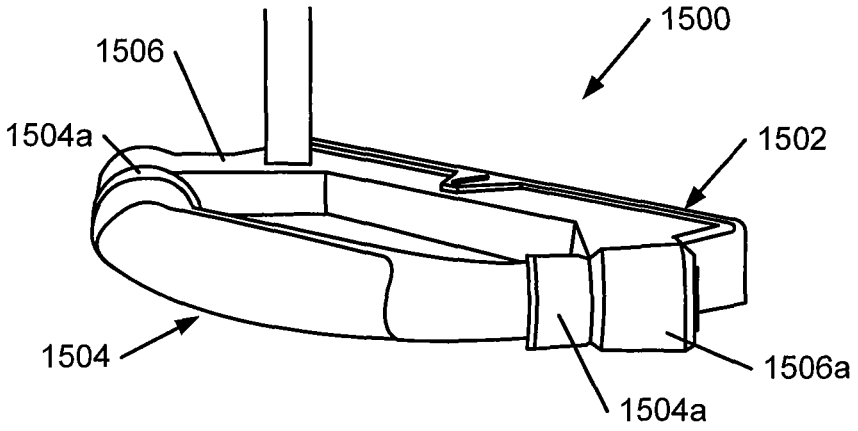
Figure 15B:
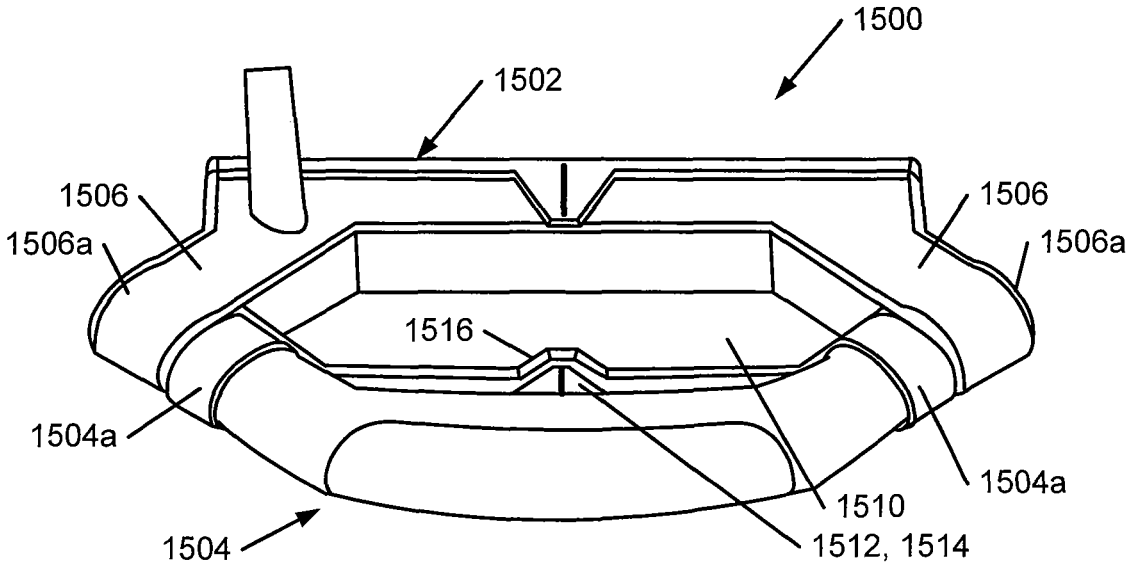
Figure 15C:
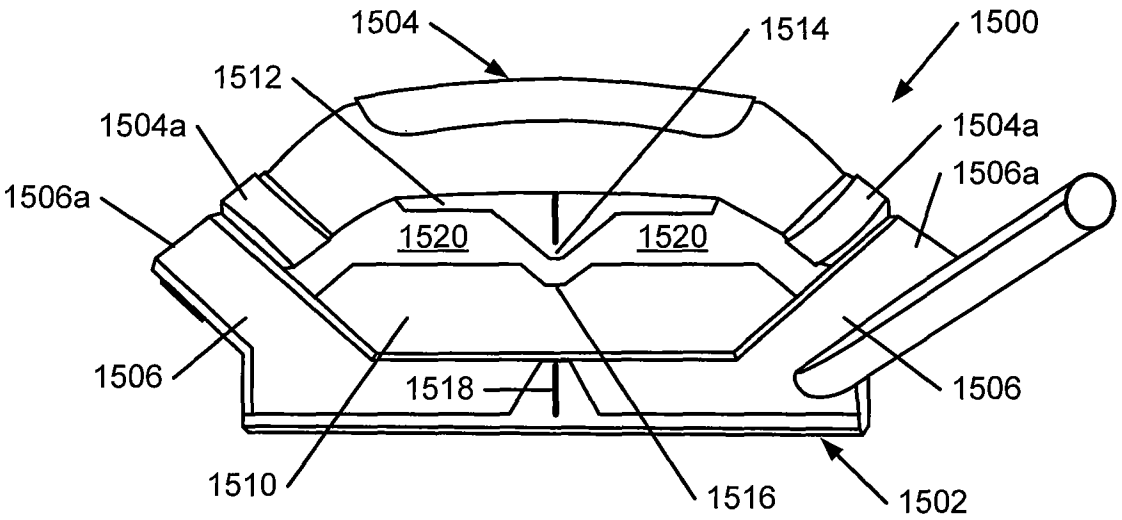

FIGS. 15A through 15C illustrate another example putter structure 1500 in accordance with at least some examples of this invention. Like the other structures discussed above, this putter structure 1500 includes a ball striking face body member 1502 and a rear body member 1504 engaged with it. The rear body member 1504 is engaged with the ball striking face body member 1502, optionally in a removable manner, through attachment elements provided at the free ends 1506*a* of the arms 1506 at the heel and toe ends of the ball striking face body member 1502. While screw elements like those described above in conjunction with FIG. 11 may be used in this example structure 1500, as another option, if desired, the rounded elements 1504*a* and the free ends of the rear body member 1504 could act as the attachment system (e.g., the elements 1504*a* could be rotatable and include a clamp member and/or a threaded portion that engages a correspondingly threaded portion provided with the free ends 1506*a* of the arms 1506).

Various features of the structure 1500 of FIGS. 15A through 15C differ from other structures described herein. For example, as best shown in FIG. 15C, the rear of the ball striking face body member 1502 includes a rearward extending surface or platform 1510 and the inside of the rear body member 1504 includes a forward extending surface or platform 1512. The rear body member 1504 platform 1512 includes an outwardly extending projection 1514 that aligns with an inwardly extending notch 1516 included in the ball striking face body member 1502 platform 1510 (a continuous open space 1520 is provided between these platforms 1510 and 1512). The aligned projection 1514 and notch 1516 are located at the center line of the putter head and provide an alignment aid for the putter 1500 (that cooperates and aligns with alignment aid 1518 provided on the top surface of the ball striking face body member 1502).

The various parts of the putter 1500 of FIGS. 15A through 15C may be made from any desired materials without departing from this invention, including the same materials described above for similar parts shown in FIG. 11 (e.g., stainless steel and rubberized tungsten for the rear body member 1504, etc.).

Figure 16A:
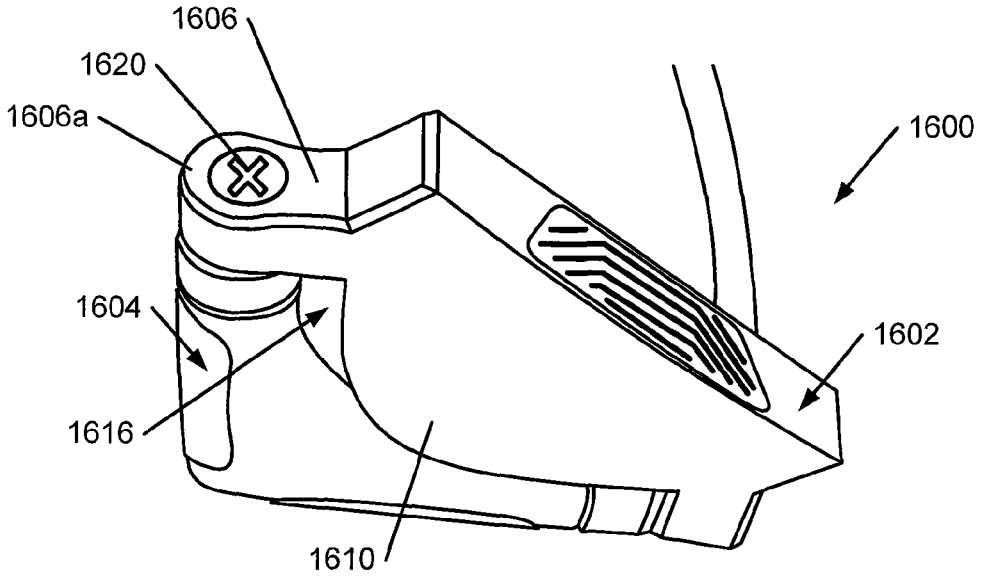
Figure 16B:
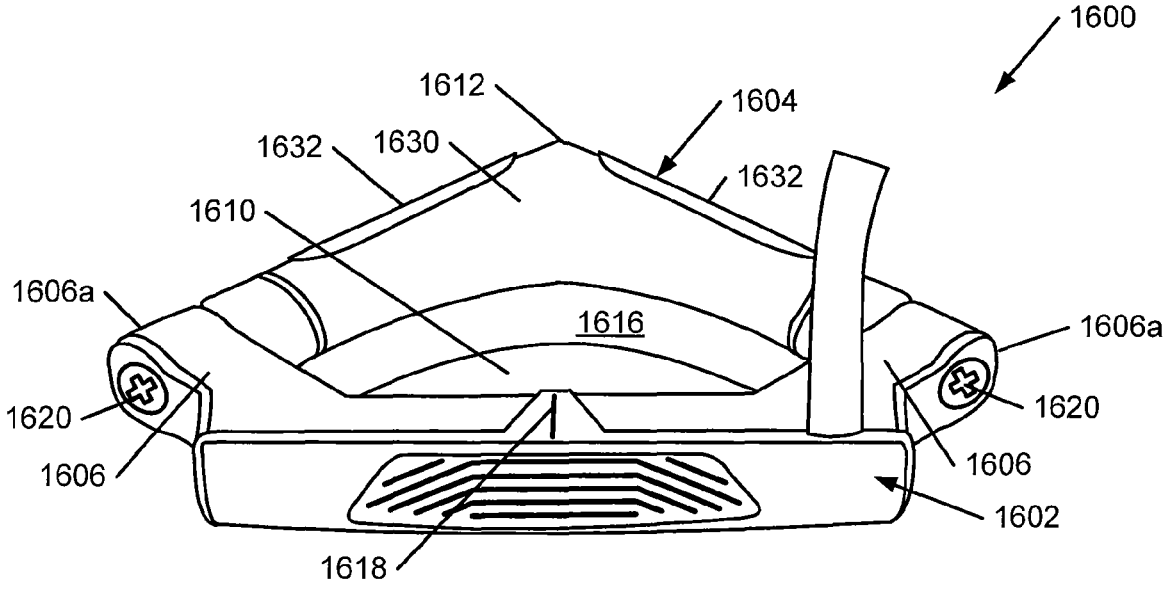

FIGS. 16A and 16B illustrate another example putter construction 1600 in accordance with at least some examples of this invention that includes many features similar to the features described above and illustrated in conjunction with FIGS. 15A through 15C. The description of these similar features will not be repeated in detail here. FIGS. 16A and 16B show weight elements 1620 mounted at the free ends 1606*a* of the arms 1606 of the ball striking face body member 1602. If desired, these weight elements 1620 also may function to secure (or help secure) the rear body member 1604 to the ball striking face body member 1602.

In this example structure 1600, the ball striking face body member 1602 includes a rearward extending surface or platform 1610, but the rear body member 1604 does not include a forward extending platform. Rather, the angular shape of the rear body member 1604, including a rearward most point 1612 at the putter head's centerline, acts as an alignment aid for this example putter 1600 (aligned with and in cooperation with the alignment aid 1618 provided at the top surface of the ball striking face body member 1602). An open space or through-hole 1616 is provided between the platform 1610 and the rear body member 1604.

The various parts of the putter 1600 of FIGS. 16A and 16B may be made from any desired materials without departing from this invention, including the same materials described above for similar parts shown in FIG. 11. As a more specific example, as with other structures described above, a rubberized tungsten material 1630 may wrap around a stainless steel material, optionally with some stainless steel material 1632 left exposed.

Figure 17A:
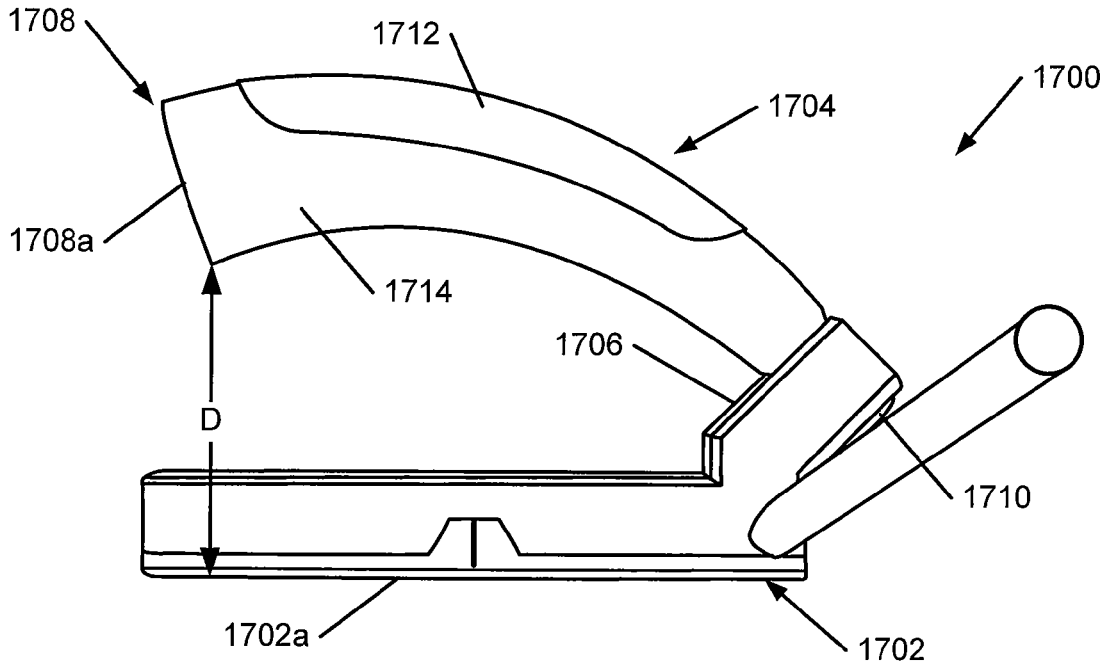
Figure 17B:
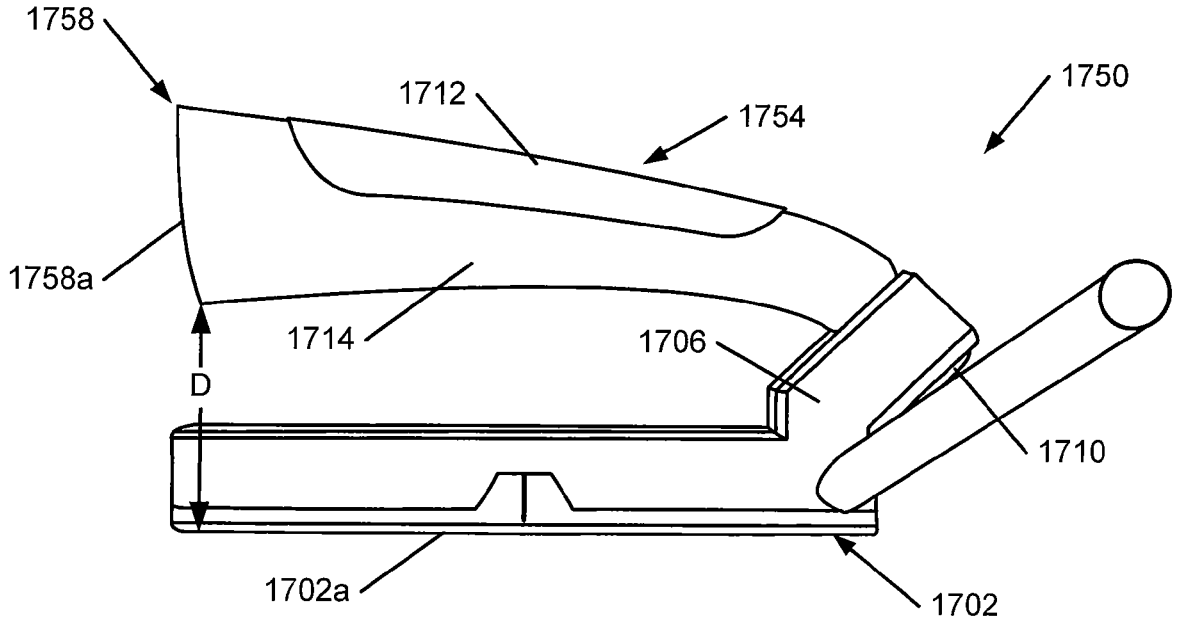

For all of the example structures noted above, the rear body member is attached to the ball striking face body member at both the heel end and the toe end of the putter head (e.g., engaged with the ball striking face body member or with an arm extending from the ball striking face body member). This is not a requirement in all example putter structures in accordance with this invention. FIGS. 17A and 17B illustrate two examples of this type of alternative construction. First, as shown in FIG. 17A, this example putter 1700 includes a ball striking face body member 1702 that includes a rearwardly (and outwardly) extending arm 1706 at a heel side edge thereof. The free end of the arm 1706 engages a rear body member 1704, optionally in a releasable manner (e.g., releasably mounted in any of the various ways described above). Rear body member 1704 extends away from the arm 1706 in an arched manner and forms the rear of the putter 1700. Notably, however, the opposite end 1708 of the rear body member 1704 (at the toe side of the putter 1700) terminates so as to leave an exposed surface 1708*a* and an unattached free end. The unattached free end of the rear body member 1704 is located at the putter toe side and is spaced rearward from the front face 1702*a* of the ball striking face body member 1702 (e.g., dimension D in FIG. 17A) by at least 1.5 inches, and in some examples, by at least 2 inches, at least 2.5 inches, or even at least 3 inches.

The putter 1750 of FIG. 17B is similar to that of FIG. 17A (and labeled with similar reference numbers), but the ball striking face body member 1702 of the example structure 1750 of FIG. 17B has a different rear body member 1754 attached to it. As compared to rear body member 1704, the rear body member 1754 is less arched and makes a more square rear surface to the overall putter 1750. Like the structure of FIG. 17A, the end 1758 of the rear body member 1754 terminates so as to leave an exposed surface 1758*a* and an unattached free end. The unattached free end of the rear body member 1754 is spaced rearward from the front face 1702*a* of the ball striking face body member 1702 (e.g., dimension D in FIG. 17B) by at least 1.25 inches, and in some examples, by at least 1.5 inches, at least 1.75 inches, or even at least 2 inches.

FIGS. 17A and 17B also highlight potential interchangeability features of putter constructions in accordance with at least some examples of this invention. For example, the more arched rear body member 1704 of FIG. 17A can be interchanged with the straighter rear body member 1754 on the same ball striking face body member 1702 (e.g., via threaded attachment element 1710). Any of the various parts may be interchangeable to enable a player or club fitter to select appropriate parts to better suit one's needs and one's preferences. If desired, an assortment of parts could be sold or otherwise made available in a kit to enable players to make changes as they desire, e.g., based on course conditions, personal preferences, green speeds, right eye/left eye dominance, etc.

The various parts of the putters 1700 and 1750 of FIGS. 17A and 17B, respectively, may be made from any desired materials without departing from this invention, including the same materials described above for similar parts shown in FIG. 11. In this illustrated example, the rear body members 1704, 1754 include stainless steel portions 1712 partially wrapped in rubberized tungsten 1714.

Figure 18A:
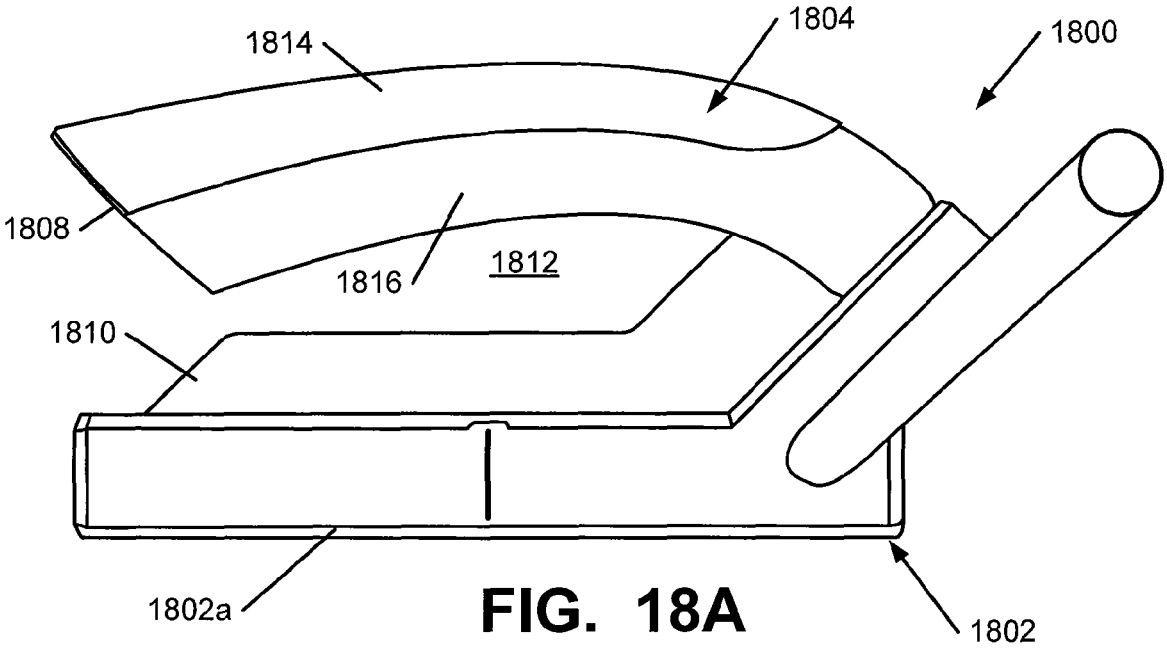

FIG. 18A illustrates another example putter structure 1800 similar to those of FIGS. 17A and 17B wherein the rear body member 1804 includes an unattached free end 1808 at the toe side of the putter 1800. In this example structure 1800, the rear of the ball striking face body member 1802 includes a rearward extending surface or platform 1810. This platform 1810 covers some of the open space 1812 between the rear body member 1804 and the ball striking face body member 1802. Covering some of this open space 1812, particularly nearer to the ball striking face 1802*a*, can provide a more consistent and less visually distracting view during the course of a putt. The platform 1810 also may help support the rear body member 1804 or it may include one or more alignment aid features (e.g., of the types described above), if desired.

Figure 18B:
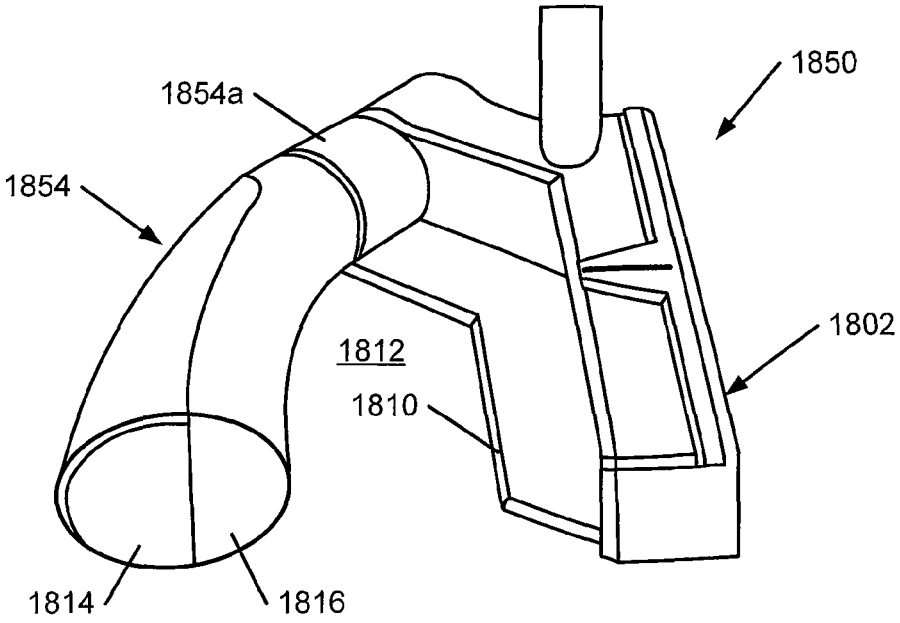

The example structure 1850 of FIG. 18B is similar to that shown in FIG. 18A except the rear body member 1854 additionally includes a securing device 1854*a* at the attached heel end. The securing device 1854*a* may be a clamp or threaded member, e.g., similar to those described above in conjunction with FIGS. 15A through 15C.

The various parts of the putters 1800 and 1850 of FIGS. 18A and 18B may be made from any desired materials without departing from this invention, including the same materials described above for similar parts shown in FIG. 11. In the illustrated example, portion 1814 is made from stainless steel and portion 1816 is made from rubberized tungsten.

Figure 19A:
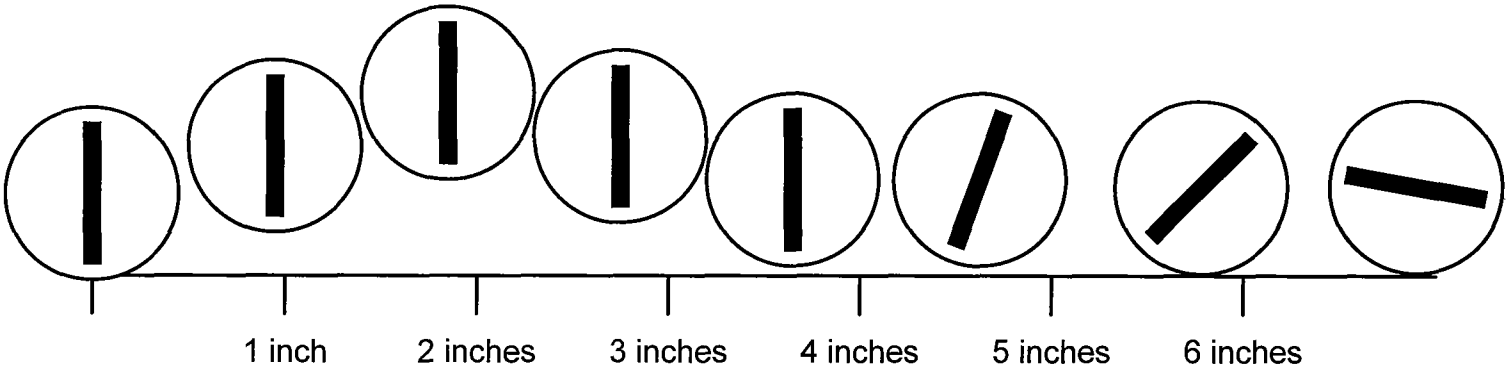
FIG. 19A (Prior Art)
FIGS. 19A and 19B illustrate at least some advantageous features that may be realized in accordance with at least some aspects of this invention.
Figure 19B:
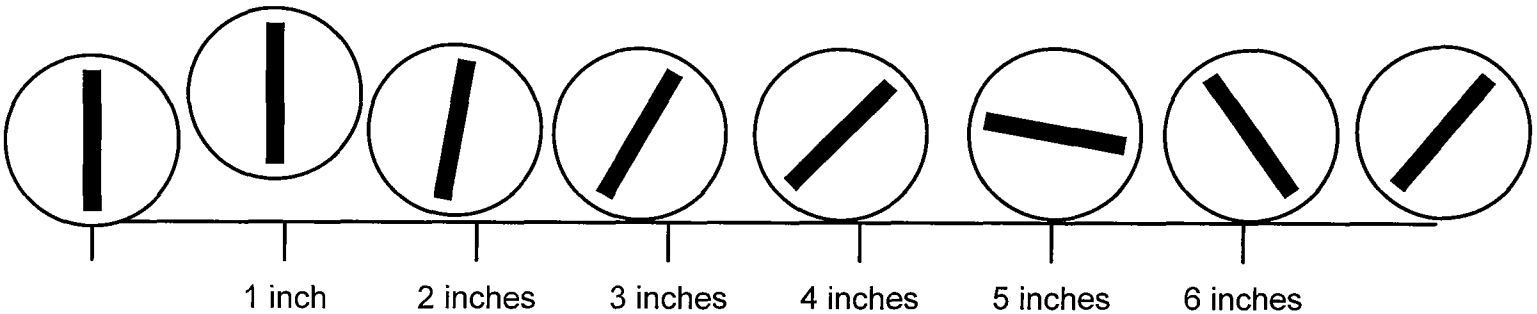

FIGS. 19A and 19B illustrate some example effects of various features of this invention, particularly in the presence of the relatively soft polymeric material at the putter head's ball striking surface (e.g., a thermoplastic polyurethane, which can somewhat grip the ball) and/or a relatively soft ball cover material. Additionally, various advantageous aspects of the invention may be provided or enhanced by including sharp grooves or scorelines in the polymer and/or metal of the ball striking face (to provide sharp edges on the putter face that can help grip the ball) and by providing a relatively low loft angle on the putter face (e.g., about 2-3° as compared to 4° or even more for conventional putters).

First, as a ball sits on the green, its weight forces it down somewhat into the grass. When putting, the putter must first somewhat "pop" the ball out of this settled condition. Therefore, putter faces generally have some loft to help launch the ball at an upward angle (e.g., loft angle Θ from FIG. 3A discussed above). This upward loft angle, however, propels the ball upward (in some instances the ball may actually leave the ground), which causes it to fly or skid across the green before it begins a true roll, as shown in FIG. 19A. This bounce or skid can introduce some inconsistency in speed, because the ball does not always "fly" or "skid" the same amount, and it can end up taking inconsistent amounts of energy off the ball during the transition between the flying and skidding mode to the true rolling mode. In some instances, the loft of the putter's ball striking face can actually put a small amount of backspin on the ball during its initial movement, which can further exacerbate the inconsistencies in the initial ball movement and ball speed.

Putter structures in accordance with at least some examples of this invention, however, may provide quicker and truer roll (and thus a more consistent roll) and a more consistent launch as compared to conventional putters. As noted above, because of the soft polymer materials and the sharp edges in the polymer and metal (e.g., from the grooves), the putter face tends to "grip" the ball a bit better during a putt (particularly if the putt is struck with somewhat of an upward swing of the putter head). These features, along with the loft angle, help "pop" the ball out of its settled condition somewhat more easily and tend to better induce top spin on the ball (which tends to keep the ball on the ground and get it rolling somewhat more quickly). Also, these features allow some example putter heads according to this invention to have a less lofted face angle (e.g., 2° or even 3° vs. a conventional 4°). Thus, the ball does not tend to launch as high out of the settled condition, causing it to more quickly contact the ground once out of the settled position, and the induced top spin helps hold the ball on the ground and gets it rolling more quickly. These features provide a more consistent and repeatable launch. A schematic diagram of an example trajectory of the ball using an example putter according to this invention is shown in FIG. 19B.

The microgrooves, as described above in conjunction with the arrangement illustrated in FIGS. 7A and 7B, also can enhance the ball grip and help impart top spin on the ball.

As shown in FIGS. 19A and 19B, putters in accordance with at least some examples of this invention may get the ball rolling much earlier during the course of a putt (e.g., within about 2 inches or less for at least some putters according to the invention vs. at about 4 to 5 inches for conventional putters, e.g., depending on the initial velocity imparted to the ball, putter against ball impact angle, etc.). Moreover, by getting the ball rolling earlier, with less bounce and skid and at a lower launch (and the uncertainty introduced into the putt due to these undesired factors), putters in accordance with at least some examples of this invention tend to provide more reliable and repeatable putting distances, putted ball speeds, and distance control.

Also, the combination of metal and polymer on the ball striking face of the putter provides a nice, soft and consistent feel (optionally controllable by selecting the hardnesses of the various parts) while still providing a more conventional "metal-on-ball" sound (or "click") of conventional putters. This sound feature also is an important part of the "feel" for many golfers, and maintaining this metallic sound helps prevent a more "dead" sound of putting a ball against a full polymer material on a putter face (e.g., as provided in many conventional putters that simply have a polymer ball striking insert or face).

Any desired polymeric material may be used in the putter head without departing from this invention, including thermoplastic or thermosetting polymeric materials, synthetic rubber type polymeric materials, etc., such as polyurethanes, vinyls (e.g., ethylvinylacetates, etc.), nylons, polyethers, polybutylene terephthalates, etc. Additionally or alternatively, recycled materials, such as recycled polymer materials, may be used in any of the above-described arrangements without departing from the invention. In some examples, portions of the club head, insert, golf club grip, etc. may be formed from a recycled material such as regrind. Regrind may include additives used in the formation of portions of the ball striking surface, club head, grip, etc., and this regrind may include finely ground recycled materials. In some examples, the finely ground recycled materials may be recycled footwear materials that may be scraps, shavings, etc. generated during manufacture, defective or used articles of footwear, and the like. The additives may include leather, cotton, thermoplastics, synthetic and natural rubber, millable/partially cross-linked polyurethane, and synthetic fibers. The thermoplastics may include polyamides, polyesters and polyurethanes.

In some examples, the regrind additives may be ground to a desired particle size and added to raw material (such as new polymeric material) to form the desired portions of the club head, grip, ball striking surface, insert, etc. In other instances, the desired portions may be formed entirely of regrind. One advantage of using regrind materials in forming portions of the putter, such as the ball striking surface, grip, insert, etc., is the reduction in waste associated with the manufacture of the articles being ground into regrind and the reduction in first-use materials in manufacturing portions of the putter. The use of recycled materials generally reduces waste that would have consumed landfill space and aids in reducing the carbon footprint of manufacturers. Additional examples of regrind materials, manufacture, etc. may be found in U.S. Pat. No. 5,346,934 to Chriss, entitled "Footwear Additive Made From Recycled Materials," which is incorporated herein by reference in its entirety.

CONCLUSION

Of course, many modifications to the putter and putter head structures and/or methods for making and using these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional production or use steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

The invention claimed is:

1. A putter head, comprising:

a ball striking head body member including a rearwardly extending body support having an opening defined therein; and a rear body member having a first end engaged at a toe side of the ball striking head body member, a second end engaged at a heel side of the ball striking head body member, and a central portion between the first end and the second end extending through the opening in the ball striking head body member;

wherein the ball striking head body member includes a first rearward extending arm at the heel side and a second rearward extending arm at the toe side, and wherein the rear body member is engaged with the first rearward extending arm and the second rearward extending arm; and wherein the rear body member is releasably engaged with the first and second rearward extending arms.

2. A putter head according to claim 1, wherein the first rearward extending arm includes: (a) a first portion extending rearwardly and substantially perpendicular to a ball striking face of the ball striking head body member and (b) a second portion extending rearward from the first portion at an angle to a location outside a heel edge of the ball striking face; and wherein the second rearward extending arm includes: (a) a first portion extending rearwardly and substantially perpendicular to the ball striking face and (b) a second portion extending rearward from the first portion of the second rearward extending arm at an angle to a location outside a toe edge of the ball striking face, wherein the rear body member is engaged with the second portions of the first and second rearward extending arms.

3. A putter head according to claim 1, wherein a first open space is defined between the ball striking head body member and the rear body member on a heel side of the rearwardly extending body support, and wherein a second open space is defined between the ball striking head body member and the rear body member on a toe side of the rearwardly extending body support.

4. A putter head according to claim 1, wherein the rear body member includes a rubberized tungsten material.

5. A putter head according to claim 1, wherein, the rear body member is releasably engaged with the first and second rearward extending arms via a first fastener that extends through the first rearward extending arm and via a second fastener that extends through the second rearward extending arm.

6. A putter head according to claim 1, wherein, one of the ball striking head member or the rear body member include at least one weight port.

7. A putter head according to claim 1, wherein the putter head has an overall breadth dimension B in a front-to-rear direction and a depth of a center of gravity in the front-to-rear direction $D_{CG}$, wherein a ratio of $D_{CG}/B$ is at least 0.425.

8. A putter head according to claim 7, wherein the ratio of $D_{CG}/B$ is at least 0.48.

9. A putter head according to claim 7, wherein the ratio of $D_{CG}/B$ is at least 0.52.

10. A putter head, comprising:

a ball striking head body member; and a rear body member having a first end engaged at a toe side of the ball striking head body member, a second end engaged at a heel side of the ball striking head body member, and a central portion between the first end and the second end, wherein the central portion includes a forwardly projecting platform that includes an alignment aid thereon;

wherein the ball striking head body member includes a first rearward extending arm at the heel side and a second rearward extending arm at the toe side, and wherein the rear body member is engaged with the first rearward extending arm and the second rearward extending arm; and wherein the rear body member is releasably engaged with the first and second rearward extending arms.

11. A putter head according to claim 10, wherein the ball striking head body member includes a rearward projecting platform that includes an alignment aid thereon, wherein the alignment aid of the central portion of the rear body member aligns with the alignment aid of the rearward projecting platform of the ball striking head body member.

12. A putter head according to claim 11, wherein the alignment aid on the forwardly projecting platform includes a projection, wherein the alignment aid on the rearward projecting platform includes a notch, and wherein the projection aligns with the notch.

13. A putter head according to claim 10, wherein the alignment aid includes a raised triangular element on the forwardly projecting platform.

14. A putter head according to claim 10, wherein the first rearward extending arm extends rearwardly from a ball striking face of the ball striking head body member at an angle to a location outside a heel edge of the ball striking face, and wherein the second rearward extending arm extends rearwardly from the ball striking face at an angle to a location outside a toe edge of the ball striking face.

15. A putter head according to claim 10, wherein an open space is defined between the ball striking head body member and the rear body member.

16. A putter head according to claim 10, wherein the rear body member includes a rubberized tungsten material.

17. A putter head according to claim 10, wherein, the rear body member is releasably engaged with the first and second rearward extending arms via a first fastener that extends through the first rearward extending arm and via a second fastener that extends through the second rearward extending arm.

18. A putter head according to claim 10, wherein, one of the ball striking head member or the rear body member include at least one weight port.

19. A putter head according to claim 10, wherein the putter head has an overall breadth dimension B in a front-to-rear direction and a depth of a center of gravity in the front-to-rear direction $D_{CG}$, wherein a ratio of $D_{CG}/B$ is at least 0.425.

20. A putter head according to claim 19, wherein the ratio of $D_{CG}/B$ is at least 0.48.

21. A putter head according to claim 19, wherein the ratio of $D_{CG}/B$ is at least 0.52.

22. A putter head, comprising:

a ball striking head body member including: (a) a first rearward extending arm at a heel side of the ball striking head body member, wherein the first rearward extending arm extends rearwardly from a ball striking face of the ball striking head body member at an angle to a location outside a heel edge of the ball striking face, and (b) a second rearward extending arm at a toe side of the ball striking head body member, wherein the second rearward extending arm extends rearwardly from the ball striking face at an angle to a location outside a toe edge of the ball striking face;

a rear body member having a first end engaged with the first rearward extending arm and a second end engaged with the second rearward extending arm, wherein the rear body member includes a rubberized tungsten material; and wherein the rear body member is releasably engaged with the first and second rearward extending arms.

23. A putter head according to claim 22, wherein the rear body member additionally includes a stainless steel material.

24. A putter head according to claim 22, wherein the first rearward extending arm includes a first weight member engaged with it and the second rearward extending arm includes a second weight member engaged with it.

25. A putter head according to claim 22, wherein an open space is defined between the ball striking head body member and the rear body member.

26. A putter head according to claim 22, wherein, the rear body member is releasably engaged with the first and second rearward extending arms via a first fastener that extends through the first rearward extending arm and via a second fastener that extends through the second rearward extending arm.

27. A putter head according to claim 22, wherein, one of the ball striking head member or the rear body member include at least one weight port.

28. A putter head according to claim 22, wherein the putter head has an overall breadth dimension B in a front-to-rear direction and a depth of a center of gravity in the front-to-rear direction $D_{CG}$, wherein a ratio of $D_{CG}/B$ is at least 0.425.

29. A putter head according to claim 28, wherein the ratio of $D_{CG}/B$ is at least 0.48.

30. A putter head according to claim 28, wherein the ratio of $D_{CG}/B$ is at least 0.52.

* * * * *